US008038406B2

(12) United States Patent
Tanigawa

(10) Patent No.: US 8,038,406 B2
(45) Date of Patent: Oct. 18, 2011

(54) AXIAL FAN AND BLADE DESIGN METHOD FOR THE SAME

(75) Inventor: Shinji Tanigawa, Gunma (JP)

(73) Assignee: SANYO Electric Co., Ltd., Moriguchi-shi (JP)

( * ) Notice: Subject to any disclaimer, the term of this patent is extended or adjusted under 35 U.S.C. 154(b) by 1090 days.

(21) Appl. No.: 11/843,860

(22) Filed: Aug. 23, 2007

(65) Prior Publication Data

US 2008/0050240 A1 Feb. 28, 2008

(30) Foreign Application Priority Data

Aug. 25, 2006 (JP) ..... 2006-229184
Aug. 25, 2006 (JP) ..... 2006-229185

(51) Int. Cl.
*F04D 29/38* (2006.01)

(52) U.S. Cl. ..... 416/223 R; 416/239

(58) Field of Classification Search ..... 416/234, 416/204 R, 239, DIG. 3; 29/889.3
See application file for complete search history.

(56) References Cited

U.S. PATENT DOCUMENTS

| | | | |
|---|---|---|---|
| 4,738,594 | A | 4/1988 | Sato et al. |
| 4,746,271 | A | 5/1988 | Wright |
| 2005/0111986 | A1 | 5/2005 | Tsai |

FOREIGN PATENT DOCUMENTS

| | | | | |
|---|---|---|---|---|
| GB | 548414 | | | 10/1942 |
| JP | 08074790 | A | * | 3/1996 |
| JP | 2001115995 | A | * | 4/2001 |
| JP | 2003065293 | A | * | 3/2003 |
| JP | 2005-105865 | A | | 4/2005 |
| JP | 3754244 | B2 | | 12/2005 |
| WO | 2006/078083 | A2 | | 7/2006 |

OTHER PUBLICATIONS

JP 08-074790A Machine Translation. Accessed JPO on Feb. 26, 2010.*
JP 2003-065293 A Machine Translation. Accessed JPO on Feb. 28, 2010.*
JP 2001-115995 A Machine Translation. Accessed JPO on Feb. 28, 2010.*

* cited by examiner

*Primary Examiner* — Richard Edgar
(74) *Attorney, Agent, or Firm* — Westerman, Hattori, Daniels & Adrian, LLP

(57) ABSTRACT

An axial fan which includes a hub portion having the rotational center thereof and blades arranged on the outer periphery of the hub portion is equipped with a thickness reinforcing portion which extends from the joint portion between the blade front edge portion of the blade and the hub portion to the outer periphery of the blade along the blade front edge and whose width and thickness are smaller as the distance from the rotational center of the hub portion is larger. There is achieved an arc corresponding to the overlap portion between the blade and a circle of a first radius which passes from the blade front edge side of the blade to the blade rear edge side and has as the center thereof any reference point displaced from the rotational center on a plane vertical to the rotational axis of the hub portion and the blade.

10 Claims, 19 Drawing Sheets

FIG.9

| RADIUS POSITION (mm) | r | 250 | 230 | 210 | 190 | 170 | 150 | 130 | 110 | 90 | 70 | 50 | 30 |
|---|---|---|---|---|---|---|---|---|---|---|---|---|---|
| FRONT EDGE POSITION (DEGREE) | SS(r) | −6 | 0 | 6 | 12 | 18 | 24 | 30 | 36 | 42 | 48 | 54 | 60 |
| START ANGLE (DEGREE) | θS(r) | 0 | 0 | 0 | 0 | 0 | 0 | 0 | 0 | 0 | 0 | 0 | 0 |
| END ANGLE (DEGREE) | θE(r) | 93 | 97 | 101 | 105 | 109 | 114 | 120 | 128 | 138 | 151 | 166 | 185 |
| ANGLE RANGE (DEGREE) | θ·L(r) | 99 | 97 | 95 | 93 | 91 | 90 | 90 | 92 | 96 | 103 | 112 | 125 |
| START HEIGHT (mm) | HS(r) | −2 | 0 | 2 | 5 | 8.5 | 13 | 19 | 26 | 34 | 42 | 49 | 56 |
| END HEIGHT (mm) | HE(r) | 180 | 180 | 180 | 180 | 180 | 180 | 180 | 180 | 180 | 180 | 180 | 180 |
| HEIGHT RANGE (mm) | HL(r) | 182 | 180 | 178 | 175 | 171.5 | 167 | 161 | 154 | 146 | 138 | 131 | 124 |
| MAXIMUM WARP DEPTH (mm) | D(r) | 43.7 | 40.0 | 36.5 | 33.1 | 29.8 | 26.9 | 24.2 | 21.9 | 19.6 | 17.4 | 15.2 | 13.1 |
| WARP FIRST HALF ANGLE (DEGREE) | W1(r) | 60.5 | 63.1 | 65.7 | 68.3 | 70.9 | 74.1 | 78.0 | 83.2 | 89.7 | 98.2 | 107.9 | 120.3 |
| WARP LAST HALF ANGLE (DEGREE) | W2(r) | 32.6 | 34.0 | 35.4 | 36.8 | 38.2 | 39.9 | 42.0 | 44.8 | 48.3 | 52.9 | 58.1 | 64.8 |

AXIAL FAN AND BLADE DESIGN METHOD FOR THE SAME

INCORPORATION BY REFERENCE

The present application claims priority under 35 U.S.C. §119 to Japanese Patent Application No. 2006-229184 filed on Aug. 25, 2006 and Japanese Patent Application No. 2006-229185 filed on Aug. 25, 2006. The content of the applications is incorporated herein by reference in its entirety.

BACKGROUND OF THE INVENTION

1. Field of the Invention

The present invention relates to an axial fan having a hub portion having a rotating center and blades arranged on the outer periphery of the hub portion, and a method of designing the blades of the axial fan.

2. Description of the Related Art

An axial fan (for example, propeller fan) for sucking gas in an axial direction and then blowing out the air in the axial direction is applied to an outdoor unit of an air conditioner, a ventilation fan, an electric fan or the like. The axial fan is equipped with a hub portion having the rotating center and a plurality of blades arranged on the outer periphery of the hub portion. Each blade is designed in a three-dimensional curved-surface shape (for example, see Japanese Patent No. 3,754,244).

In order to enhance the structural rigidity of this type of axial fan, the thickness of each blade may be increased. However, if the thickness of each blade is increased, the whole weight of the fan itself is increased, and centrifugal force acting on the fan itself is increased, so that the strength to the centrifugal force is reduced. On the other hand, when the rotational number of a fan motor is suppressed under control in order to reduce the centrifugal force acting on the fan, there occurs a problem that the air blowing performance of the fan is greatly reduced.

Furthermore, this type of axial fan has a noise problem that noise occurs at the outer peripheral side of the axial fan due to blade tip vortex occurring at the outer peripheral side of each blade or the like. In order to suppress this blade tip vortex, it has been proposed to partially change the shape of the blade to provide an additional blade to a basic blade (For example, JP-2005-105865).

When the blade of this type of axial fan is designed, the cross-sectional shape in the peripheral direction of the blade and the cross-sectional shape in the radial direction of the blade are defined by using mathematical formulas defined by several parameters, and the blade is designed by using these mathematical formulas (for example, Japanese Patent No. 3,754,244). This design method is applied to a blade having a three-dimensional curved surface which has no additional blade, and it has been difficult to partially change the shape of the blade. Therefore, a work of designing a blade having an additional blade is complicated, and also it is difficult to assess the best blade shape.

SUMMARY OF THE INVENTION

An object of the present invention is to provide an axial fan which can be enhanced in rigidity and strength to centrifugal force and also for which an additional blade can be easily designed, and a method of designing each blade of the axial fan.

In order to attain the above object, according to a first aspect of the present invention, according to an aspect of the present invention, an axial fan containing a hub portion having a rotational center and blades arranged on the outer periphery of the hub portion, includes a thickness reinforcing portion that has a predetermined width and a predetermined thickness and extends along a blade front edge from a joint portion between a blade front edge portion of each blade and the hub portion to the outer periphery of the blade, wherein the width and thickness of the thickness reinforcing portion are made smaller as the distance from the rotational center of the hub portion is larger.

According to the above axial fan, the thickness reinforcing portion extending along the blade front edge from the joint portion between the blade front edge portion and the hub portion to the outer periphery of the blade is provided, and the width and thickness of the thickness reinforcing portion are smaller as the distance from the rotational center of the hub portion is larger. Therefore, the strength of the blade and the joint strength between the blade and the hub portion are enhanced, and the strength to centrifugal force is enhanced.

In the above axial fan, it is preferable that the width and thickness of the thickness reinforcing portion are set to substantially zero at a predetermined position on the blade front edge at a blade front edge tip portion side.

In the above axial fan, it is preferable that the thickness reinforcing portion is designed so that a plane area surrounded by a first curved line which extends from the predetermined position to the joint portion and is coincident with the outline of the blade front edge, and a second curved line achieved by rotating a curved line extending from the predetermined position along the outline of the blade front edge in the peripheral direction around the predetermined position by a predetermined angle, the second curved line extending to the intersection point between the curved line concerned and the hub portion, is set to a joint plane to the blade in the thickness reinforcing portion.

In the above axial fan, it is preferable that a thickness distribution curve is defined by using a logarithmic curve containing the distance from the rotational center of the hub portion as a variable, and the thickness reinforcing portion is designed so that the thickness thereof is based on the thickness distribution curve.

In the above axial fan, it is preferable that the thickness distribution curve is calculated by applying a least-square method to a logarithmic function having plural parameters as a basic function so as to achieve an approximating curve passing through two points of a thickness maximum position at the joint portion and a thickness minimum position corresponding to the position farthest from the rotational center of the hub portion, and the thickness reinforcing portion is designed so as to have the thickness based on the thickness distribution curve.

In the above axial fan, it is preferable that the thickness reinforcing portion is provided at a positive pressure plane side of the blade.

According to another aspect of the present invention, a method of designing a blade of an axial fan including a hub portion having a rotational center and blades arranged on the outer periphery of the hub portion, comprises the steps of: defining end portions of the blade indicated by an angle in a peripheral direction by using mathematical formulas when a coordinate system containing the rotational center as an original point on a plane perpendicular to the rotational axis of the blade is set, and defining a radial cross-sectional shape of the blade at any angular position in the coordinate system by using mathematical formulas containing as a variable the difference between the distance from any point to the rotational center at the angular position concerned and the distance from the blade tip to the rotational center at the angular position concerned, thereby designing a basic blade of the blade; and setting a first curved line that extends from any position T on the blade front edge to a joint portion between the hub portion and the blade and is coincident with the outline of the blade front edge, setting a second curved line that is achieved by rotating a curved line having the same curvature as the outline of the blade front edge around the position T1 concerned in a peripheral direction by a predetermined angle and extends from the position T1 to the intersection point between the curved line concerned and the hub portion, a plane area surrounded by the firsts and second curved lines being set as a joint plane to the blade in the thickness reinforcing portion, defining the first and second curved lines specifying the joint plane concerned by using mathematical formulas containing as variables the position T1 and the predetermined rotational angle or the intersection point T3 between the second curved line and the hub portion, and defining a thickness distribution shape of the thickness reinforcing portion by using mathematical formulas containing the thickness maximum value hm at the joint portion and the position T1 when the thickness of the thickness reinforcing portion is smaller as the distance from the rotational center of the hub portion is larger, thereby designing the thickness reinforcing portion of the blade.

In the above blade designing method for the axial fan, it is preferable that the width and thickness of the thickness reinforcing portion are set to substantially zero at a predetermined position on the blade front edge at the blade front edge tip portion side.

In the above blade designing method for the axial fan, it is preferable that a thickness distribution curve using a logarithmic curve containing the distance from the rotational center of the hub portion as a variable is defined, and the thickness reinforcing portion is designed so that the thickness thereof is based on the thickness distribution curve.

In the above blade designing method for the axial fan, it is preferable that the thickness distribution curve is determined by calculating an approximating curve passing through two points of a thickness maximum position hm at the joint portion and a thickness minimum position corresponding to a position farthest from the rotational center of the hub portion according to a least-square method using a logarithmic function, and the thickness reinforcing portion is designed so that the thickness thereof is based on the thickness distribution curve.

In the above blade designing method for the axial fan, it is preferable that the thickness reinforcing portion is provided to a positive pressure plane side of the blade.

According to another aspect of the present invention, a blade designing method for an axial fan including a hub portion and blades arranged on the outer periphery of the hub portion, comprises the steps of: defining end portions of the blade indicated by an angle in a peripheral direction by using mathematical formulas when a coordinate system containing the rotational center as an original point on a plane perpendicular to the rotational axis of the blade is set, and defining a radial cross-sectional shape of the blade at any angular position in the coordinate system by using mathematical formulas containing as a variable the difference between the distance from any point to the rotational center at the angular position concerned and the distance from the blade tip to the rotational center at the angular position concerned, thereby designing a basic blade of the blade; and drawing a first circle having a blade front edge tip portion of the basic blade at the center thereof and a first radius corresponding to the distance between the blade front edge tip portion and the rotational center, setting on the first circle a reference point which is displaced in a peripheral direction from the rotational center by a first angle, setting an arc corresponding to the overlap portion between a second circle having any second radius drawn around the reference point and the surface of the basic blade as a blade shape changing start portion of an additional blade, defining the blade shape changing start portion by using a mathematical formula containing at least one of the first angle and the second radius as a variable, and defining the curved surface shape of the additional blade by using a mathematical formula containing three values of a maximum variation amount of the curved surface, a gradient variation position of the additional blade and a maximum variation position of the additional blade as variables, thereby designing the additional blade of the blade.

In the above blade designing method for the axial fan, it is preferable that the radius concerned is equal to the radius of the first circle.

In the above blade designing method for the axial fan, it is preferable that when the additional blade is designed at a outer peripheral portion of the blade, the outer peripheral side of the blade is bent with respect to the blade shape changing start portion.

In the above blade designing method for the axial fan, it is preferable that when an additional blade is designed on a blade surface excluding the outer peripheral portion of the blade, an additional blade projecting to the negative pressure plane side of the blade is designed at the blade shape changing start portion.

In the above blade designing method for the axial fan, it is preferable that a mathematical formula representing a variation amount of the curved surface of the additional blade is defined by using a first formula for smoothly connecting the tip portion of the blade front edge of the blade and the gradient variation position of the additional blade, a second formula representing a quadratic curve for smoothly connecting the gradient variation position and the maximum variation position of the additional blade, and a third formula representing a quadratic curve for smoothly connecting the maximum variation position and the curved surface end position.

According to another aspect of the present invention, there is provided a blade designing method for an axial fan including a hub portion having the rotational center thereof and blades arranged on the outer periphery of the hub portion, comprises the steps of: defining end portions of the blade indicated by an angle in a peripheral direction by using mathematical formulas when a coordinate system containing the rotational center as an original point on a plane perpendicular to the rotational axis of the blade is set, and defining a radial cross-sectional shape of the blade at any angular position in the coordinate system by using mathematical formulas containing as a variable the difference between the distance from any point to the rotational center at the angular position concerned and the distance from the blade tip to the rotational center at the angular position concerned, thereby designing a basic blade of the blade; and drawing a first circle having a blade front edge tip portion of the basic blade at the center thereof and a first radius corresponding to the distance between the blade front edge tip portion and the rotational center, setting on the first circle a reference point which is displaced in a peripheral direction from the rotational center by a first angle, setting an arc corresponding to the overlap portion between a second circle having any second radius drawn around the reference point and the surface of the basic blade as a blade shape changing start portion of an additional blade, defining the blade shape changing start portion by using a mathematical formula containing at least one of the first angle and the second radius as a variable, and defining the curved surface shape of the additional blade by using a mathematical formula containing as variables predetermined parameters for defining the cross-sectional shape in the peripheral direction of the additional blade, thereby designing the additional blade of the blade.

In the above blade designing method for the axial fan, it is preferable that the predetermined parameters are a maximum variation amount of the curved surface of the additional blade, a gradient variation position of the additional blade, and a maximum variation position of the additional blade.

BRIEF DESCRIPTION OF THE DRAWINGS

FIG. 9 is a diagram showing a blade shape changing start portion in the basic blade;

DETAILED DESCRIPTION OF THE PREFERRED EMBODIMENTS

Preferred embodiments according to the present invention will be described hereunder with reference to the accompanying drawings.

First Embodiment

Figure 1:
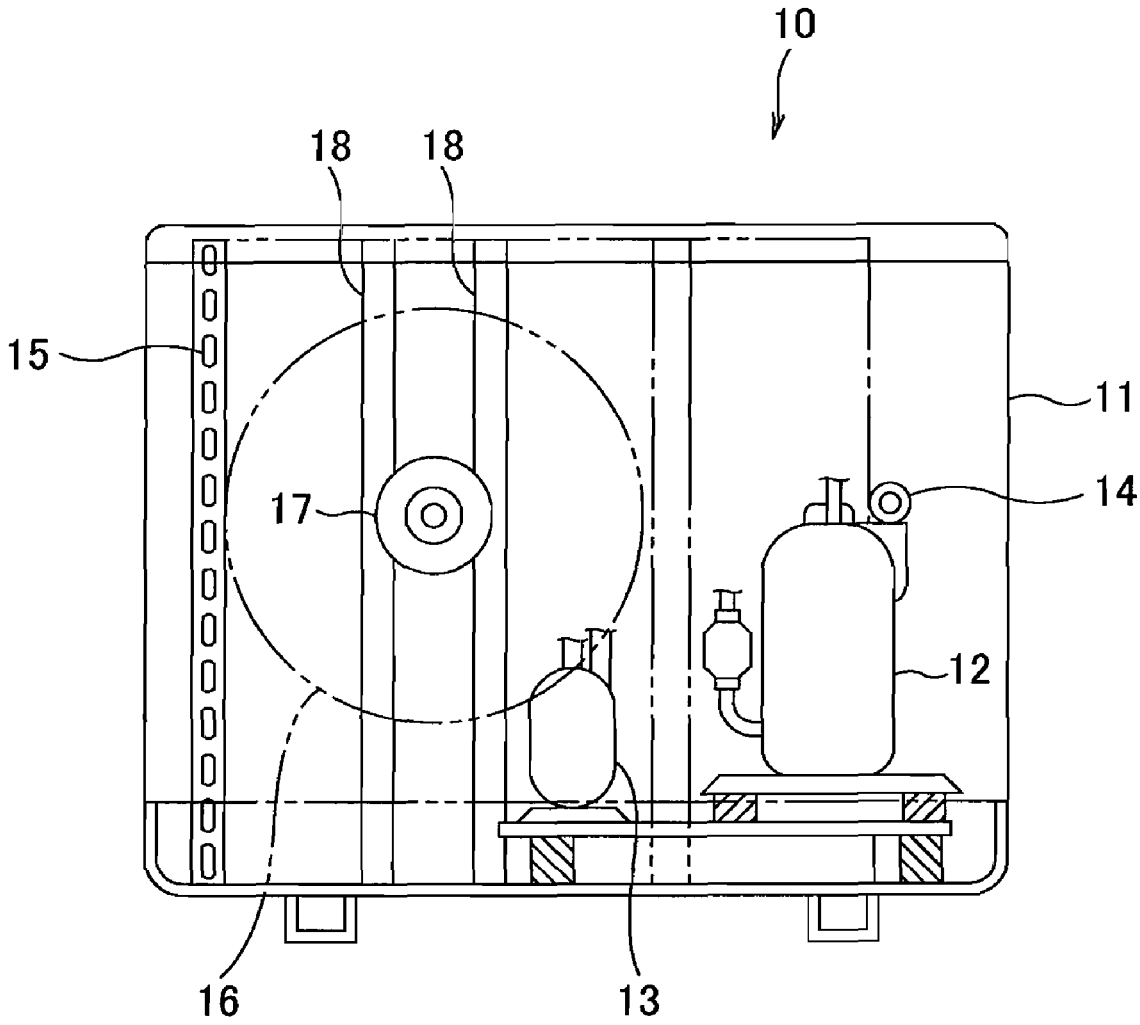
FIG. 1 is a diagram showing an outdoor unit to which a propeller fan according to a first embodiment of an axial fan of the present invention is applied.

FIG. 1 is a diagram showing an outdoor unit to which a propeller according to a first embodiment of an axial fan of the present invention is applied. The outdoor unit 10 is disposed outdoors, and it is connected through pipes to an indoor unit (not shown) mounted on the ceiling or wall of a room to thereby constitute an air conditioner. The air conditioner performs cooling operation and heating operation by making refrigerant flow through a refrigerant circuit comprising the outdoor unit 10 and the indoor unit. The outdoor unit 10 heat-exchanges outside air with refrigerant. Under cooling operation, the refrigerant is condensed and radiate heat to the outside air, and under heating operation, the refrigerant is evaporated and absorb heat from the outside air.

Figure 2:
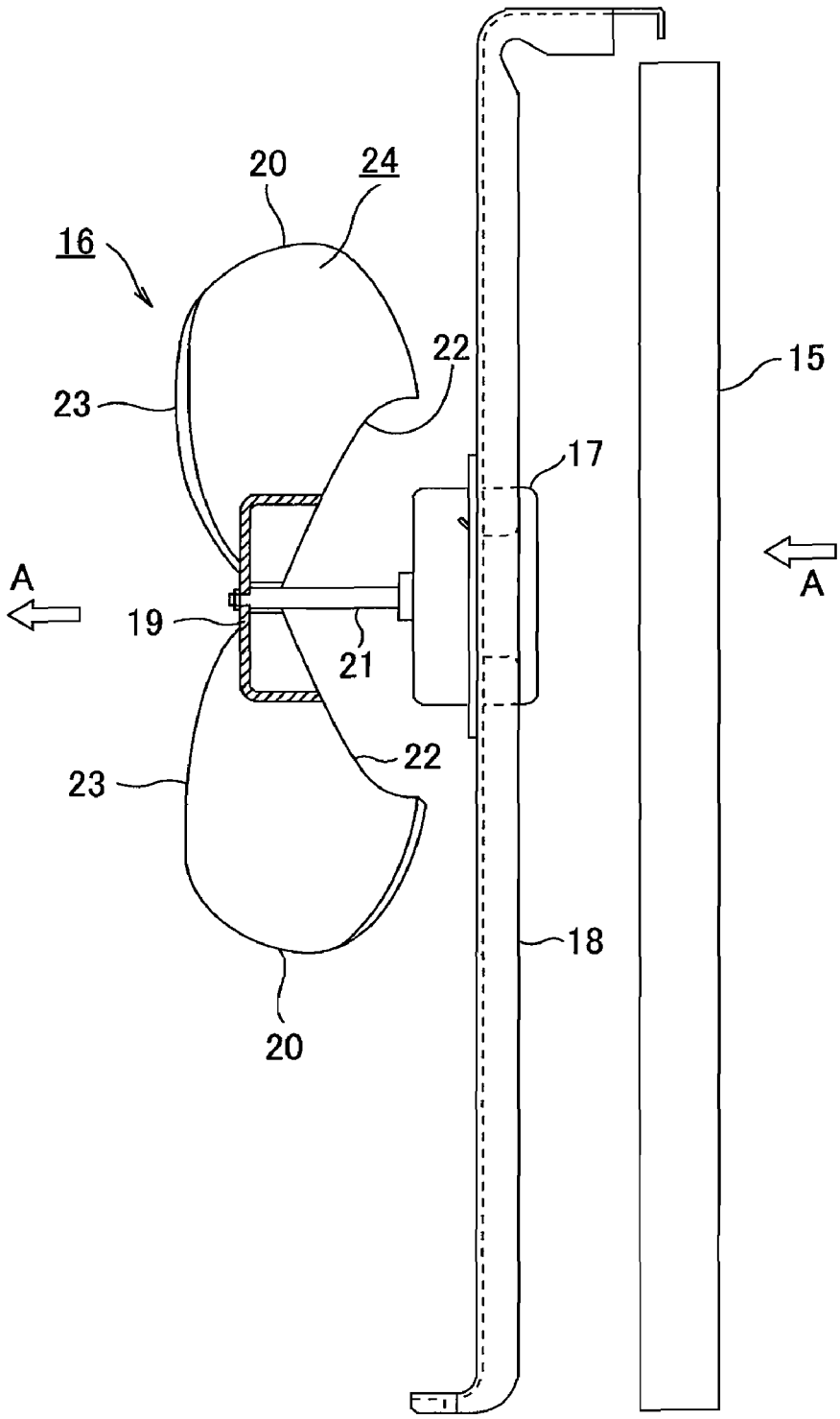
FIG. 2 is a diagram showing a main part of the outdoor unit.

The outdoor unit 10 is constructed by a compressor 12, an accumulator 13, a four-way valve 14, a heat exchanger 15 and a propeller fan 16 as an axial fan which are accommodated in a casing 11. The propeller fan 16 is joined to a fan motor 17 as shown in FIG. 2, and the fan motor 17 is supported by a support plate 18 and disposed in front of the heat exchanger 15. The propeller fan 16 is driven by the fan motor 17 to blow air (outdoor air) from the inside of the heat exchanger 15 to the outside of the heat exchanger 15 as indicated by an arrow A of FIG. 2, so that the refrigerant and the outdoor air are heat-exchanged with each other in the heat exchanger 15.

Figure 3:
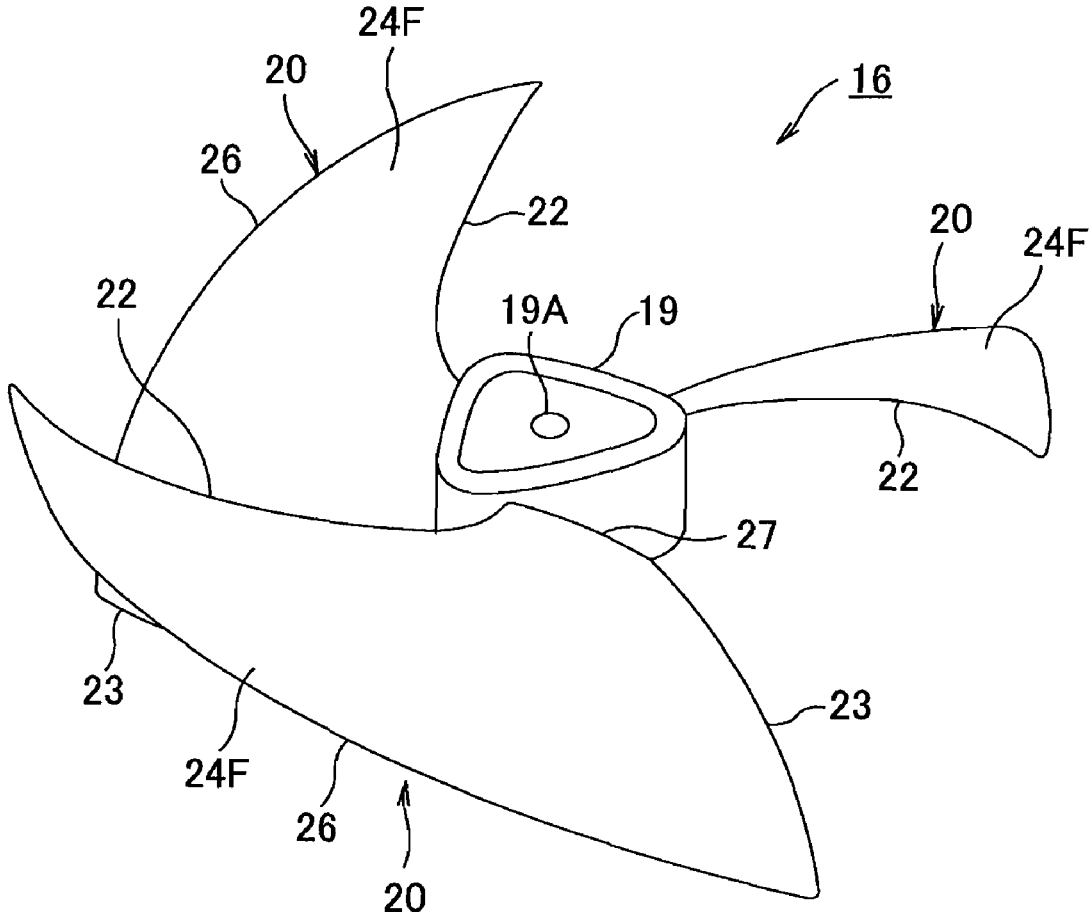
FIG. 3 is a perspective view showing a propeller fan.
Figure 4:
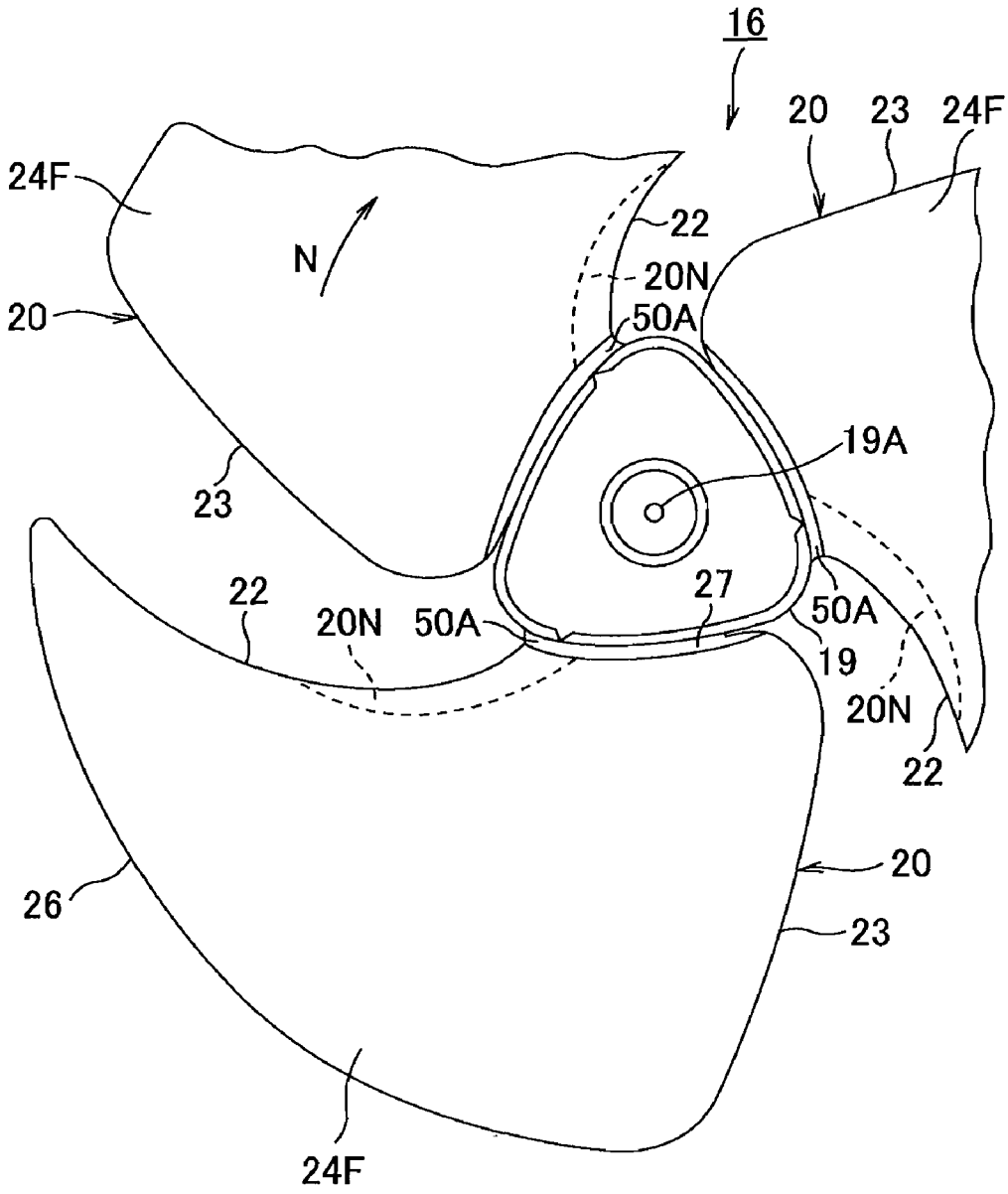
FIG. 4 is a side view showing the propeller fan.

As shown in FIGS. 3 and 4, the propeller fan 16 is constructed by a hub portion 19 and a plurality of (for example, three) blades 20 which are arranged at a predetermined pitch on the outer periphery of the hub portion 19. The hub portion 19 and the blades 20 are integrally molded with resin.

The motor shaft 21 (FIG. 2) of the fan motor 17 is inserted in the rotational center 19A of the hub portion 19, and each blade 20 is rotated in an arrow N direction of FIG. 3 by driving the fan motor 17. The hub portion 19 is designed so that the outer shape thereof is a substantially triangular-prism shape.

Figure 5:
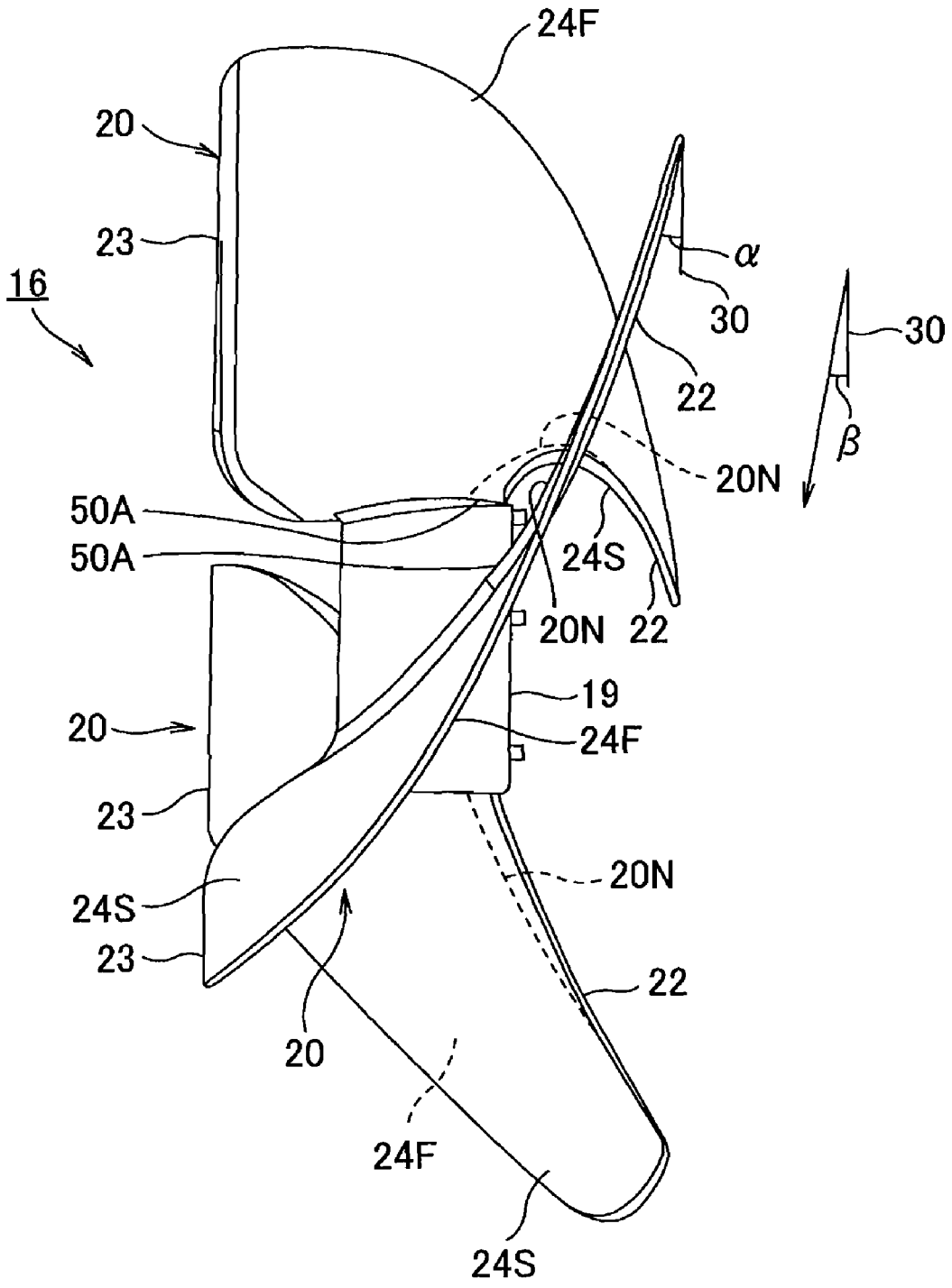
FIG. 5 is a diagram showing the shape of a basic blade of the propeller fan.

As shown in FIGS. 3 to 5, the blade 20 makes air (outside air) flow along the blade negative pressure plane (the back surface of the blade) from the blade front edge 22 side to the blade rear edge 23 side by the rotation thereof in the arrow N direction, so that the air flows in the direction of an arrow A of FIG. 2 from the back side of the propeller 16 to the front side thereof as a whole.

As shown in FIGS. 4 and 5, this blade 20 is designed to have such a three-dimensional curved surface shape that the blade surface is spatially distorted and the blade front edge 22 side thereof is greatly tilted forward to the air suction side.

It has been known that blade tip vortex occurs due to air stream spooled from the blade positive pressure plane (blade front surface) 24S to the blade negative plane (blade back surface) 24F. This type of vortex causes noise (air blow sound). With respect to recent propellers, there is a case where noise is reduced by changing the shape of a propeller, for example by changing the curved surface of the blade rear edge 23 or the blade outer periphery or the like. The change of the blade shape may reduce the rigidity of the fan and thus it is necessary to increase the rigidity in some cases.

Therefore, according to the propeller 16 of this embodiment, as shown in FIGS. 4 and 5, a thickness reinforcing portion 20N which extends along the blade front edge portion 22 from the joint portion 50A between the blade front edge portion 22 and the hub portion 19 to the blade outer periphery is provided to the blade 20 of the propeller fan 16 of this embodiment. The strength and rigidity of the propeller fan 16 can be enhanced by these thickness reinforcing portions 20N, and also the shape change of the curved surface of the blade rear edge 23 or the blade outer periphery which is effective to reduce the noise can be compensated.

Next, a method of designing this blade 20 by using an arithmetic processing unit which can perform arithmetic processing such as a personal computer or the like will be described. When this blade 20 is designed, the design process is divided to a basic blade design step for designing a blade having only a basic curved surface which is provided with no thickness reinforcing portion 20N (hereinafter referred to as "basic blade 20A"), and a thickness reinforcing portion design step for partially adding the thickness reinforcing portion 20N to the basic blade 20A which is designed in the basic blade designing step. Through these steps, coordinate data representing a three-dimensional shape of the blade 20 can be achieved.

These coordinate data are usable as design data by input the data to a three-dimensional CAD (Computer Aided Design), for example. The design data can be also actively used as processing data by inputting these data to a mold-making apparatus for manufacturing a metal mold used to mold the blade 20.

<Basic Blade Design Step>

First, the design of the basic blade 20A will be described.

The shape of the basic blade 20A (three-dimensional shape) is defined by using two cross-sectional shapes, a cross-sectional shape in a peripheral direction (hereinafter referred to as "peripheral cross-sectional shape") and a cross-sectional shape in a radial direction (hereinafter referred to as "radial cross-sectional shape") in a coordinate system in which the rotational center 19A is set to the original point O on a plane perpendicular to the rotating shaft of the propeller fan 16. Specifically, weight is given to the peripheral cross-sectional shape which is important to determine the air blowing performance of the propeller fan 16, and the peripheral cross-sectional shape at any radius r from the original point O is defined by a mathematical formula. With respect to the radial cross-sectional shape, it is varied while the peripheral cross-sectional shape is kept, and thus it is defined by adding the peripheral cross-sectional shape with the difference (r−R) between the maximum radius R of the basic blade 20A and the radius r concerned (r−R).

Figure 6:
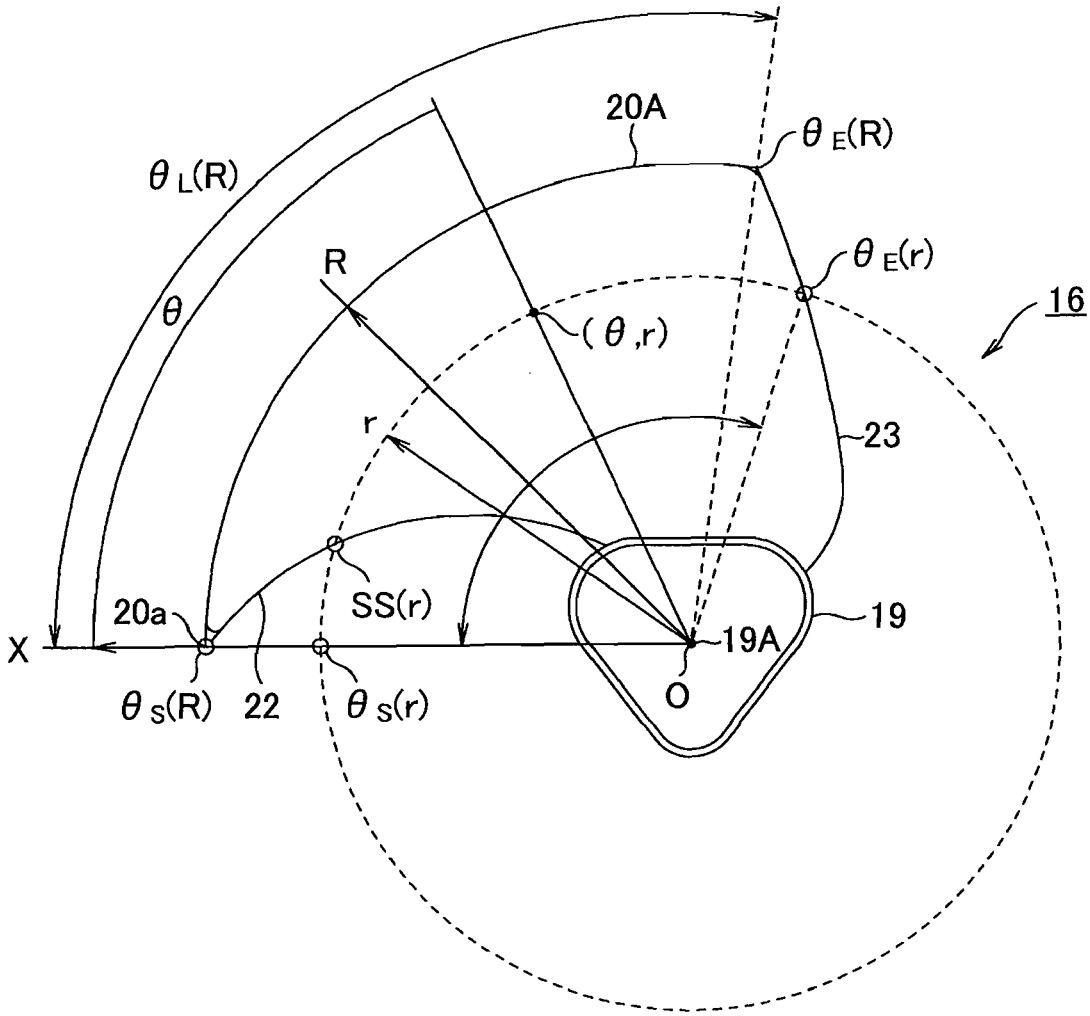
FIG. 6 is a diagram showing the cross-sectional shape in the peripheral direction of the basic blade at a radius r position of FIG. 5.
Figure 7:
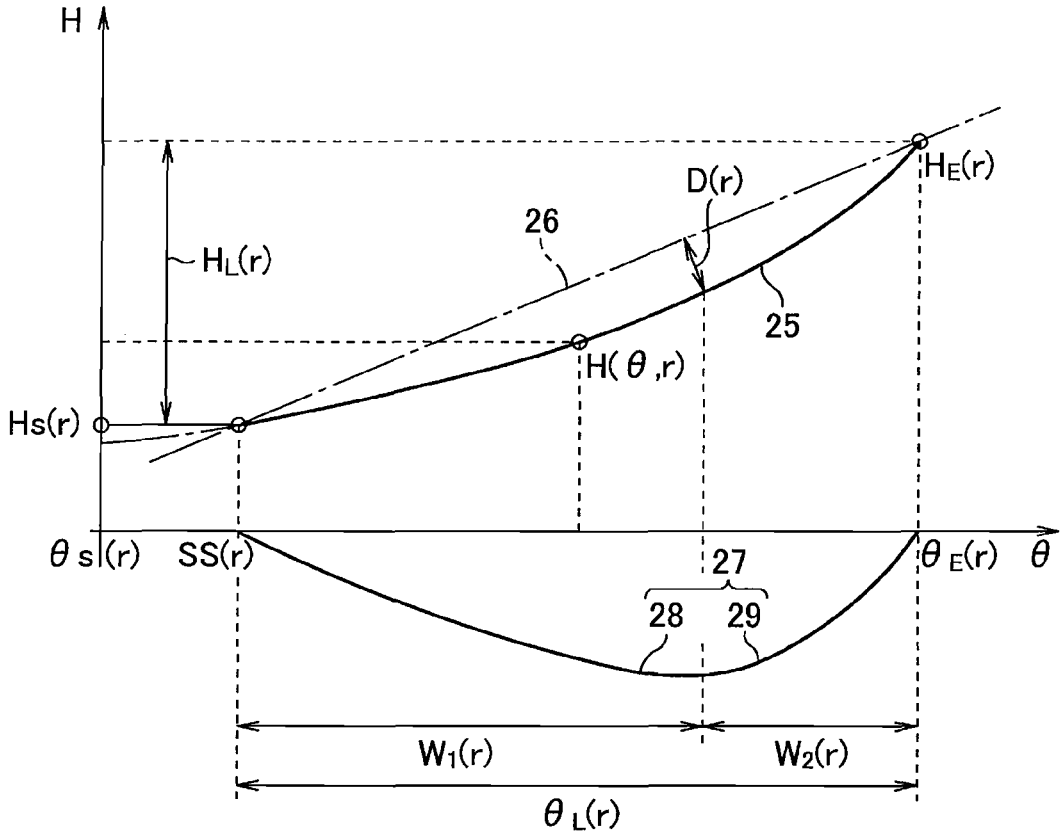
FIG. 7 is a graph showing the relationship of an attack angle of the blade front edge of the basic blade, a blade inflection point distribution factor, and a reference maximum warp depth of the blade.

The peripheral cross-sectional shape the basic blade 20A at any radius r from the original point O is shown in FIG. 7. A curved line 25 representing the peripheral cross-sectional shape of the basic blade 20A is achieved by subtracting a curved line 27 from a blade chord line 26. The curved line 27 is constructed by connecting two different quadratic curves 28 and 29 at the peak position thereof. A designer can set various blade cross-sectional shapes by setting these quadratic curve 27 (28, 29) to any curved lines or desired curved lines which are determined according to his/her empirical rule. Here, the abscissa axis of FIG. 7 represents an angle θ in the peripheral direction of the basic blade 20A which increases clockwise from the horizontal axis X passing through the original point O of FIG. 6, and the ordinate axis represents the blade height H of the basic blade 20A.

The mathematical formula representing the peripheral cross-sectional shape of the blade 20 represented by the curved line 25 is added with the relational expression (r−R) in the radial direction of the basic blade 20A, and the three-dimensional shape of the basic blade 20A is represented by the following mathematical formulas (1) and (2):

$$\text{For } \theta \le W_1(r) + \theta_S(r) \tag{1}$$

$$H(\theta, r) = D(r) \times \left\{ \frac{(\theta - W_1(r) - \theta_S(r))^2}{W_1^2} - 1 \right\} + \frac{H_L(r)}{\theta_L(r)} \times (\theta - \theta_S(r)) + H_S(r)$$

-continued $$\text{For } \theta > W_1(r) + \theta_S(r) \tag{2}$$

$$H(\theta, r) = D(r) \times \left\{ \frac{(\theta - W_1(r) - \theta_S(r))^2}{W_2^2} - 1 \right\} + \frac{H_L(r)}{\theta_L(r)} \times (\theta - \theta_S(r)) + H_S(r)$$

Here, $W_1(r)$ represents a warp first half angle and $W_2(r)$ represents a warp last half angle. They are parameters for determining the peak position of the curved line 27, and are functions of the radius r as indicated by the following equations (8) and (9). $\theta_S$ (r) is a parameter representing the start angle of the basic blade 20A (the blade front edge 22 side), and it is a function of the radius r.

Furthermore, $\theta_L(r)$ in the equations (1) and (2) is a parameter representing the angle range of the basic blade 20A. This is a function of the radius r, and defined by the following equation (3).

$$\theta_L(r)=\theta_E(r)-SS(r) \tag{3}$$

Here, $\theta_E(r)$ is a parameter representing the end angle of the basic blade 20A (the blade rear edge 23 side), and it is a function of the radius rand represented by the following equation (4). SS(r) is a parameter representing the position of the blade front edge 22 of the blade 20. It is set from the top projection view of the basic blade 20A and represented as a function of the radius r as shown in the following equation (5).

$$\theta_E(r)=A_1(r-R)^3+B_1(r-R)^2+C_1(r-R)+D_1 \tag{4}$$

$$SS(r)=A_2(r-R)^3+B_2(r-R)^2+C_2(r-R)+D_2 \tag{5}$$

In the equations (4) and (5), $A_1$, $A_2$, $B_1$, $B_2$, $C_1$, $C_2$, $D_1$, $D_2$ represent constants.

$H_L(r)$ in the equations (1) and (2) is a parameter representing the height range of the basic blade 20A. It is a function of the radius r and represented by the following equation (6).

$$H_L(r)=H_E(r)-H_S(r) \tag{6}$$

Here, $H_E(r)$ represents the end height of the basic blade 20A (the blade rear edge 23 side), and it is set to any value. $H_S(r)$ is a parameter representing the start height of the blade 20 (the blade front edge 22 side), and it is set in consideration of the connection position to the hub portion 19. This parameter is represented as a function of the radius r as indicated in the following equation (7).

$$H_S(r)=A_3(r-R)_3+B_3(r-R)^{2+}C_3(r-R)+D_3 \tag{7}$$

$A_3$, $B_3$, $C_3$, $D_3$ represent constants. When the blade inflection point distribution rate for determining the ratio of the warp first half angle $W_1(r)$ and the warp last half angle $W_2(r)$ is represented by P, they are represented by the following equations (8) and (9).

$$W_1(r)=P\times(\theta_E(r)-\theta_S(r)) \tag{8}$$

$$W_2(r)=(1-P)\times(\theta_E(r)-\theta_S(r)) \tag{9}$$

Furthermore, D(r) in the equations (1) and (2) is a parameter representing the maximum warp depth of the basic blade 20A (that is, the maximum distance between the blade chord line 26 and the curved line 25 of FIG. 6), and it is a function of the radius r as indicated by the following equation (10).

$$D(r) = \tag{10}$$

-continued $$D_0 \times \sqrt{\left(\frac{2\pi r\theta_L(r)^2}{360}\right) + H_L(r)^2} + \sqrt{\left(\frac{2\pi R\theta_L(R)^2}{360}\right) + H_L(R)^2}$$

Here, $D_0$ is a parameter representing the reference maximum warp depth, and it represents the maximum warp depth D(R) at the maximum radius R position of the basic blade 20A.

The three-dimensional shape of the basic blade 20A is determined according to the equations (1) to (10). In this determining step, the outermost peripheral position of the basic blade 20A, that is, the maximum radius R position is set as a reference.

Furthermore, in the equations (4), (5), (7), the relational expression (r−R) of the radial cross-sectional shape of the basic blade 20A is added. The equations (4), (5) and (7) defining the end angle $\theta_E(r)$ of the basic blade 20A, the blade front edge 22 position SS(r) and the start height $H_S(r)$ of the basic blade 20A respectively are defined by cubic polynomials so that when plural basic blades 20A are combined with one another to form one propeller fan 16, the basic blades 20A do not interfere with one another, and thus these equations are considered to be flexibly adapted to the restrictions of the shapes of the blade front edge 22 side and the blade rear edge 23 side of the basic blade 20A.

Furthermore, as indicated by one-dotted chain line of FIG. 7, the start angle $\theta_S(r)$ of the basic blade 20A is a start point for defining the curved line 25 representing the peripheral cross-sectional shape of the basic blade 20A at each position in the radial direction of the basic blade 20A. The actual basic blade 20A is formed by cutting out unnecessary portions from the curved line 25 defined between the start angle $\theta_S(r)$ and the end angle $\theta_E(r)$ of the basic blade 20A so that the blade plane is suppressed from being distorted. This cut-out position concerned is the position SS(r) of the blade front edge 22 of the basic blade 20A. The expansion and distortion in the radial direction of the basic blade 20A can be set on the basis of the value of the start angle $\theta_S(r)$ of the basic blade 20A.

Next, the procedure of designing the three-dimensional shape of the propeller 16 by using the equations (1) to (10) will be described.

First, the numerical value of the maximum radius R of the basic blade 20A is set (for example, R=230 (mm)), and the numerical values of the reference maximum warp depth $D_0$ and the blade inflection point distribution rate P are set in consideration of the attack angle α of the blade front edge 22 side and the incident angle β of air. In addition, the numerical values of the end angle $\theta_E(R)$ and the blade end height $H_E(R)$ of the outermost periphery of the blade and the coefficients An, Bn, Cn, Dn of the terms of the relational expression (r−R) associated with the radial cross-sectional shape of the basic blade 20A are set. Furthermore, the start angle $\theta_S(r)$ of the basic blade 20A is set to zero ($\theta_S(r)=0$).

Here, as shown in FIG. 5, the attack angle α of the basic blade 20A is an intersection angle of the blade front edge 22 to the flat plane 30 perpendicular to the rotational center 19A of the propeller 16 (hub portion 19). The incident angle β of air is a flow-in angle of air to the propeller fan 16 with respect to the flat plane 30. The incident angle β of air is dispersed due to the mutual interference of air among the blades 20 of the propeller fan 16 and in accordance with the position in the radial direction of each basic blade 20A, and thus it is difficult to grasp the incident angle β accurately. However, it is empirically determined from the existing propeller fan. When the attack angle α of the basic blade 20A is excessively small, it is not adaptable to variation of air stream, and thus the propeller 16 may stall. Therefore, the attack angle α is set to a proper angle larger than the incident angle β of air.

Figure 8:
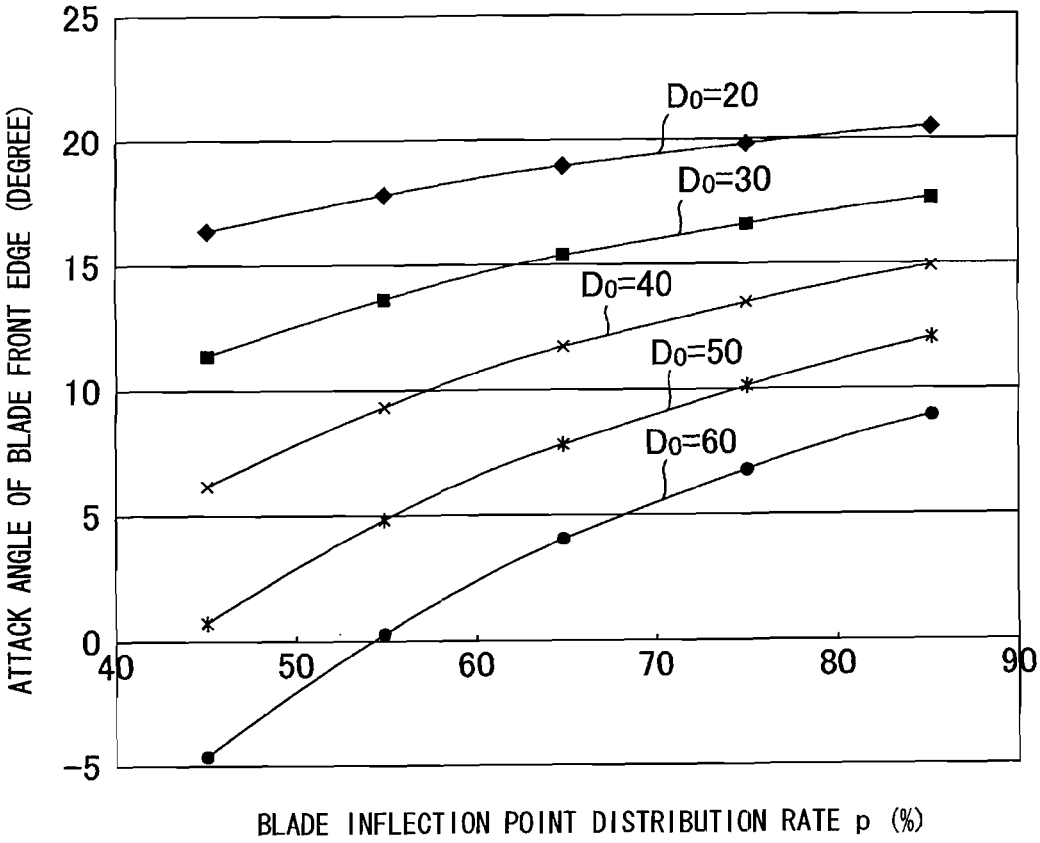
FIG. 8 is a graph showing the values of parameters at each position in the radial direction of the basic blade.

As shown in FIG. 8, for example, in order to set the attack angle α of the basic blade 20A to 12 degrees or more, it is desirable that the reference maximum warp depth $D_0$ is set to 40 (mm) or more when the blade inflection point distribution rate P is set to 65%. In this embodiment, the numerical values are set as follows: α=12 (degree), P=65(%) and $D_0$=40 (mm).

Next, the respective values of the numerical values of the parameters R, $D_0$, P, $\theta_E(R)$, $H_E(R)$, $A_n$, $B_n$, $C_n$, $D_n$, $\theta_S(r)$ are substituted into the equations (4), (5), (3), (7), (6) to calculate the parameters $\theta_E(r)$, SS(r) , $\theta_L(r)$, $H_S(r)$, $H_L(r)$, and the calculated numerical values of these parameters are substituted into the equations (8) and (9) to calculate the parameters $W_1(r)$ and $W_2(r)$. Furthermore, the numerical values of the above parameters are substituted into the equation (10) to calculate the parameter D(r).

Next, the values of the parameters $\theta_E(r)$, SS(r), $\theta_L(r)$, $H_S(r)$, $H_L(r)$, $W_1(r)$, $W_2(r)$ and D(r) at each position in the radial direction of the basic blade 20A (for example, r=250, 230, 210, 190, 170, 150, 130, 110, 90, 70, 50, 30, . . . ). FIG. 9 is a table showing a list of these numerical values. In FIG. 9, the values of the parameters $\theta_S(r)$ and $H_E(r)$ are shown in the table.

Thereafter, the numerical values of FIG. 9 are substituted into the equations (1) and (2), and a function of θ indicating the peripheral cross-sectional shape of the basic blade 20A at each position in the radial direction of the basic blade 20A (r=250, 230, 210, . . . ) is calculated, and then the numerical value of θ is substituted into each equation to calculate the value of the blade height H of the blade 20. Accordingly, many coordinate data of H(θ, r) representing the three-dimensional shape of the basic blade 20A are achieved as a point group. The above process is the method of designing the basic blade 20A.

According to the design method of the basic blade 20A, the basic shape of the blade 20 of the propeller fan 16 is determined by defining and constructing the peripheral cross-sectional shape and the radial cross-sectional shape by using the equations (1) to (10), whereby the cross-sectional shape of the blade 20 can be designed by using different quadratic curves 28 and 29 shown in FIG. 7. Accordingly, the blade 20 having a complicated shape can be designed and manufactured. Therefore, it is easy to design the blade surface of the blade 20 to be smooth by changing the equations of the various parameters, prevent occurrence of resistance due to existence of extreme curvature variation on the blade surface, properly secure the air flow amount based on the propeller fan 16 by adjusting the numerical value of the maximum warp depth D(r) of the blade 20, and also clarify the difference in action between the blade front edge 22 side and the blade rear edge 23 side of the blade 20 by adjusting the position of the maximum warp depth D(r) of the blade 20 by using the blade inflection point distribution rate P. As a result, the blade 20 of the propeller 16 which can be applied to a broad field can be implemented.

<Thickness reinforcing portion Design Step>

Next, the design of the thickness-increased reinforced portion 20N will be described.

As shown in FIG. 4, the thickness reinforcing portion 20N is provided to the blade positive pressure surface (blade front surface) 24S side. It is designed to extend from the joint portion 50A between the blade front edge 22 portion (blade front edge portion) of the blade 20 and the hub portion 19 to the blade outer periphery along the blade front edge 22, and to be substantially semi-spherical when viewed from the front side of the blade 20.

Figure 10:
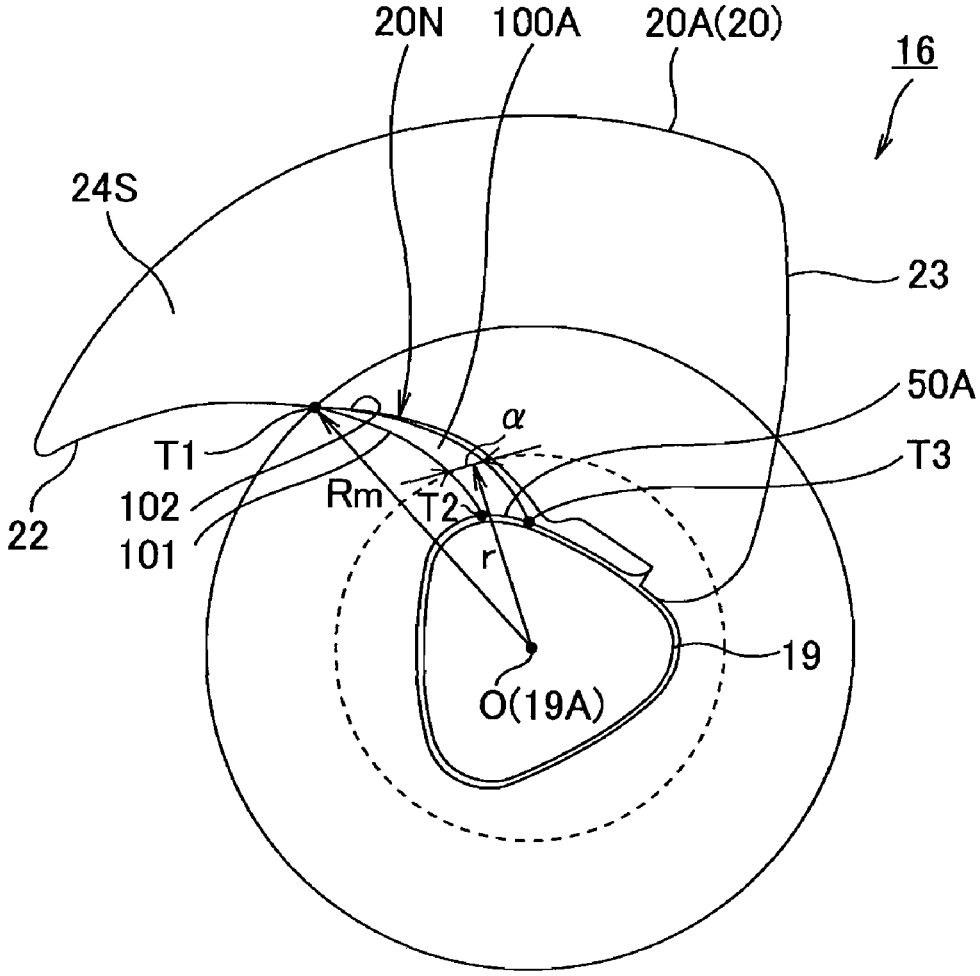
FIG. 10 is a cross-sectional view in the radial direction of the blade.

The thickness reinforcing portion 20N is designed so that in the coordinate system in which the rotational center 19A on the plane vertical to the rotational axis of the propeller fan 16 is set to the original point O, the thickness and the width of the thickness reinforcing portion 20N are smaller as the distance (corresponding to the radius r (r<Rm)) from the original point O is larger as shown in FIG. 10. Here, Rm represents the distance between the original point O and the outermost peripheral position T1 of the thickness reinforcing portion 20N.

Figure 11:
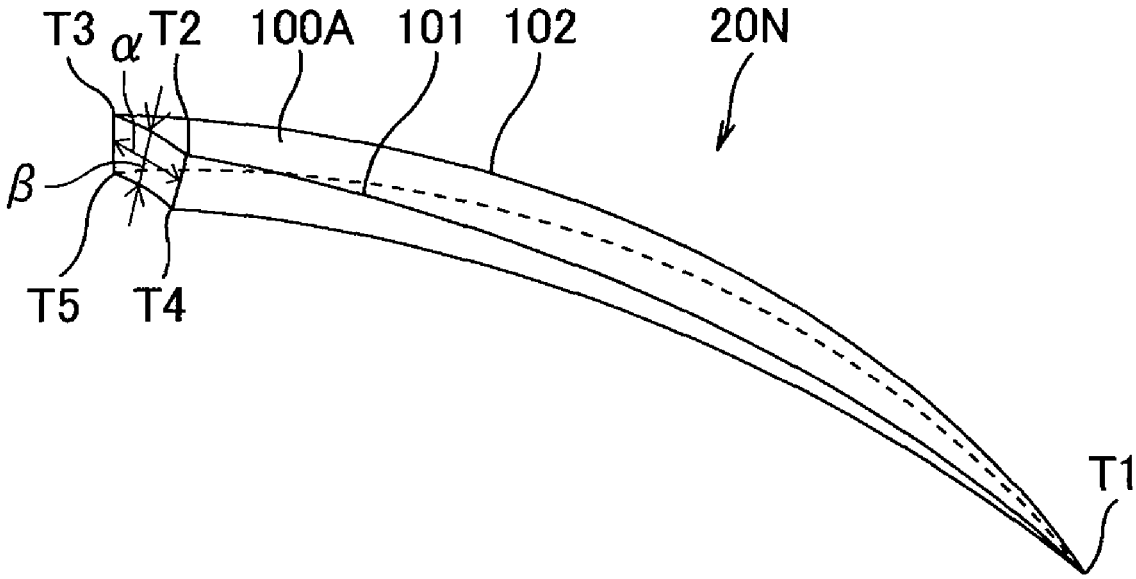
FIG. 11 is a diagram showing the cross-sectional shape in the peripheral direction of the outermost periphery of an additional blade.

FIG. 11 is a diagram showing an example of the shape of the thickness reinforcing portion 20N. When the thickness reinforcing portion 20N is designed, a joint plane 100A to the blade positive pressure surface (blade front surface) 24S is first set.

Specifically, when the joint plane 100A is set, the outermost peripheral position T1 of the thickness reinforcing portion 20N is set on the blade front edge 22, and a first curved line 101 and a second curved line 102 are set so as to extend from the outermost peripheral position T1 to outer peripheral positions T2, T3 of the hub portion 19 so that the interval between the first and second curved lines 101 and 102 are larger as shown in FIGS. 10 and 11, thereby setting the joint plane 100A comprising the plane area defined by the first and second curved lines 101 and 102. Here, the outer peripheral positions T2 and T3 are set at the positions corresponding to the joint portion 50A between the blade front edge 22 portion (blade front edge portion) of the blade 20 and the hub portion 19. Specifically, the position T2 corresponds to the intersection point between the curved line 101 and the hub portion 19 and the position T3 corresponds to the intersection point between the curved line 102 and the hub portion 19.

Particularly, as the first curved line 101 is applied a curved line which extends from the outermost peripheral position T1 to the joint portion 50A side (the outer peripheral position T2) in contact with the blade front edge 22 and is coincident with the outline of the blade front edge 22. In other words, the first curved line 101 is a curved line which is coincident with the outline of the blade front edge 22 and has one end at the outermost peripheral position T1 and the other end at the outer peripheral position T2. Furthermore, as the second curved line 102 is applied a curved line which has the curvature coincident with the curvature of the locus of the blade front edge 22 (that is, the curvature of the outline of the blade front edge 22)and is arranged on the blade positive pressure surface 24s so as to extend from the one end of the first curved line 101, that is, the outermost peripheral position T1 to the joint portion 50A (the outer peripheral position T3). For example, when the outermost peripheral position T1 and the outer peripheral positions T2, T3 are determined, the first curved line 101 is determined. In this case, the first curved line 101 is counterclockwise rotated around the outermost peripheral position T1 in FIG. 10 until an extension line of the first curved line 101 which extends from the position T2 toward the inside of the hub portion 19 intersects to the position T3, thereby achieving a curved line which has one end at the positions T1 and the other end at the position T3 and also has the same curvature as the first curved line 101. The curved line thus achieved may be set as the second curved line 102.

As described above, the curved line having the curvature coincident with the locus (outline) of the blade front edge 22 as in the case of the first curved line 101 is applied as the second curved line 102 defining the joint plane 100A of the thickness reinforcing portion 20N in cooperation with the first curved line 101, and thus the second curved line 102 which extends from the position T1 to the inner peripheral side of the blade while the interval between the first curved line 101 and the second curved line 102 is gradually increased from the position T1 to the joint portion 50A can be easily set by using only the above curved line.

Accordingly, the joint plane 100A whose width is gradually increased from the outermost peripheral position T1 toward the arc T2-T3 can be easily created. That is, the substantially semi-circular (crescent-shaped) joint plane 100A which is smaller in width as the distance (the radius r) from the original point is larger and thus narrower as the distance from the original point O is larger can be easily achieved. The width of the thickness reinforcing portion 20N (represented by a in FIGS. 10 and 11) corresponds to the distance between the first curved line 101 and the second curved line 102. For example, there are assumed a third curved line which is located at the intermediate position between the first and second curved lines 101 and 102 from the outermost peripheral position T1 to the joint portion 50A and a circle having the original point O at the center thereof and a radius r. In this case, when the tangent line of the circle at the intersection point between the third curved line and the circle is intersected to the first curved line 101 at a first point P1 and to the second curved line 102 at a second point P2, the distance between the intersection points P1 and P2 is set as the width of the thickness reinforcing portion 20N.

Figure 12:
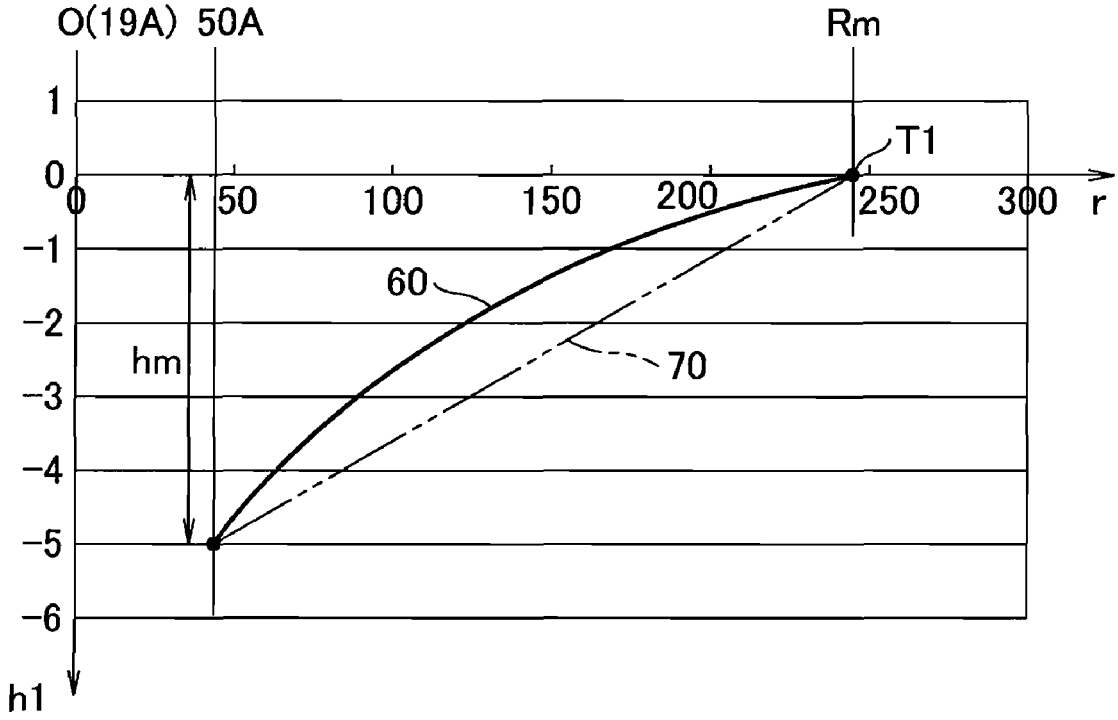
FIG. 12 is a diagram showing a modification of the blade shape changing start portion of the basic blade.

FIG. 12 shows a thickness distribution shape (cross-sectional shape) of the thickness reinforcing portion 20N at the radius r position from the original point O. Here, the thickness (represented by β in FIG. 11) of the thickness reinforcing portion 20N means the length in the same direction as the thickness of the basic blade 20A. In other words, it means the length in substantially the same direction as the rotational axis (the direction perpendicular to the width (α)).

Here, a logarithm curve using as a variable the distance (radius r) from the rotational center 19A (original point O) of the hub portion 19 in FIG. 10 is applied as a curved line (thickness distribution curved line) 60 representing the thickness distribution of the thickness reinforcing portion 20N. The logarithmic curve is set so as to pass through two points, that is, the outermost peripheral position T1 as the minimum thickness position and the position of the joint portion 50A (any position on the arc T4-T5 in FIG. 11) as the maximum thickness position. For example, an approximating curve passing through the two points (or neighboring points of the two points) may be determined from a logarithmic curve by a predetermined statistical method (for example, least-square method or the like). More specifically, a plurality of basic logarithmic functions having plural (for example, two) parameters are prepared, and the parameters are calculated by selecting a desired logarithmic function having unknown parameters and applying the statistic method such as the least-square method or the like to the selected logarithmic function with the two points, thereby determining the parameters (i.e., settling the logarithmic function as the approximating function).

For example, $h1=a\times\log r+b$ (a and b represent parameters) is prepared and selected as a basic logarithmic function to determine an approximating function for the thickness distribution curve. Here, Here, r represents the radius from the rotational center (original point O), and h1 represents the thickness of the thickness reinforcing portion at the radius r. At this time, when the radius r is equal to Rm, the height (thickness) h1 is equal to zero, and when the radius r is equal to the position of the joint portion (r0), the thickness h1 is equal to hm. A basic logarithmic function which approximately passes through this two points (0, Rm) and (hm, r0) can be determined by the least-square method (parameters a, b are determined).

The parameters of the basic logarithmic functions are not limited to two parameters, and two or more parameters may be prepared. Furthermore, a plurality of basic logarithmic functions to be used may be prepared. However, when the number of parameters is increased, the number of parameters to be input is increased, and thus the processing time is longer. Therefore, it is better that the number of parameters is as small as possible. For example, as in the case of this embodiment, the first and second curved lines are determined by using only two parameters (for example, T1, T3) (T2 is necessarily determined because the outline of the blade front edge of the fan is known). That is, the width of the thickness reinforcing portion is determined. Furthermore, the thickness of the thickness reinforcing portion (the approximating function) is determined by using the position T1 as the zero-thickness position (the thickness minimum position Rm), the thickness value (hm in FIG. 12) at the position T2 (T3) as the thickness maximum position, and the preset basic logarithmic function containing two parameters according to the least-square method or the like. By using a solid model of the thickness reinforcing portion thus achieved, the shape of the reinforcing portion can be determined.

In FIG. 12, a straight line 70 is a thickness distribution curve which connects the outermost peripheral position T1 as the thickness minimum position and the joint portion 50A as the thickness maximum position by a straight line, and the thickness distribution curve 60 is reduced in thickness with respect to the straight line 70 between the two points.

When the thickness reinforcing portion 20N is actually designed, for example equations for determining the first curved line 101 and the second curved line 102 which specify the joint plane 100A of the thickness reinforcing portion 20N are defined. Furthermore, by using an arithmetic processing unit, the numerical value of the outermost peripheral position T1 is indicated, and the first curved line 101 and the second curved line 102 are determined, thereby achieving the coordinate data of the joint plane 100A.

Furthermore, the outermost peripheral position T1 and the thickness maximum value (the thickness at the joint portion 50A) hm are set as variables, and for example an equation for specifying the thickness distribution curve 60 is defined. By using an arithmetic processing unit, the thickness distribution curve 60 is determined, and all the coordinate data of the thickness reinforcing portion 20N can be calculated from the achieved coordinate data of the joint plane 100A on the basis of the thickness distribution curve 60.

In this case, the position of the thickness maximum value hm (corresponding to the arc T4-T5 shown in FIG. 11) can be easily specified by presetting the position of the joint portion 50A (corresponding to the position of the arc T2-T3 shown in FIG. 11, for example). Therefore, the coordinate data of the joint plane 100A are achieved from the outermost peripheral position T1 and the thickness maximum value hm, and also the thickness distribution curve 60 is determined. On the basis of these results, the equation for achieving the coordinate data of the thickness reinforcing portion 20N can be defined. Accordingly, the design of the thickness reinforcing portion 20N can be easily performed. The above process is the method of designing the thickness reinforcing portion 20N.

In this embodiment, the thickness reinforcing portion 20N is provided so as to extend from the joint portion 50A of the blade front edge portion and the hub portion 19 to the outer periphery of the blade along the blade front edge 22, and the width and thickness of the thickness reinforcing portion 20N are smaller as the distance (radius r) from the rotational center 19A of the hub portion 19 is larger. Accordingly, the strength of the blade 20 and the joint strength between the blade 20 and the hub portion 19 can be enhanced by the thickness reinforcing portion 20N.

In addition, the increase of the mass of the thickness reinforcing portion 20N is smaller toward the outer peripheral side of the blade 20. Therefore, as compared with a case where the blade is uniformly thick over the area thereof, the weight of the blade can be reduced as a whole, and the increase of the centrifugal force can be suppressed, so that the strength to the centrifugal force can be enhanced.

Furthermore, the thickness is formed at only the blade front edge 22 side of the blade 20, and thus it is easy to change the shape of the blade by changing the curved surface of the blade rear edge 23 or the blade outer periphery or the like to reduce noise. Therefore, this embodiment is suitable for the reinforcement of the propeller fan 16 for which the curved surface of the blade rear edge 23 or the blade outer periphery is changed (enhancement in rigidity and strength to centrifugal force).

Furthermore, in this embodiment, when the joint plane 100A of the thickness reinforcing portion 20N is set, the first curved line 101 which is one curved line specifying the joint plane 100A is set to a curved line extending from the outermost peripheral position T1 to the joint portion 50A in contact with the blade front edge 22, and the second curved line 102 which is located to be nearer to the blade rear edge 23 side than the first curved line 101 and specifies the joint plane 100A is set to a curved line achieved by positioning changing (rotating around the outermost peripheral position) the first curved line 101 so as to have the same curvature as the outline of the blade front edge 22. Therefore, the substantially semicircular (crescent-shaped) joint plane 100A in which the width is smaller as the distance (radius r) from the original point O is larger can be easily and surely achieved.

Furthermore, the thickness distribution curve 60 for specifying the thickness of the thickness reinforcing portion 20N on the basis of the distance (radius r) from the rotational center 19A of the hub portion 19 is defined, and the thickness reinforcing portion 20N is designed so as to have the thickness based on the thickness distribution curve 60. Therefore, the design of the thickness can be easily performed and also the thickness distribution curve 60 can be determined from the logarithmic curve which is achieved from the two points of the outermost peripheral position T1 as the thickness minimum position and the thickness maximum position specified from the thickness maximum value hm according to the least-square method, for example. Accordingly, the thickness distribution curve 60 in which the thickness is smaller as the distance (radius r) from the original point O is larger can be easily and surely set.

Accordingly, by adopting these design methods, a program containing equations for achieving the coordinate data of the thickness reinforcing portion 20N by merely indicating the outer peripheral position T1 and the thickness maximum value hm can be created, and the design of the thickness reinforcing portion 20N and the design change can be easily performed.

In the first embodiment described above, the logarithmic curve is applied as the thickness distribution curve 60, however, the thickness distribution curve 60 is not limited to the logarithmic curve. For example, other curved lines such as a quadratic, etc. may be used as the basic function. In short, an approximating curve achieved on the basis of at least two points (the thickness minimum position (the outermost peripheral position T1) and the thickness maximum position (the position of the joint portion 50A) according to the statistical method such as the least-square method or the like. In this case, it is preferable to use as the approximating function such a basic function that the thickness at the outermost peripheral position is equal to zero and the thickness is larger toward the hub side. Furthermore, it is desirable that the number of parameters in the basic function is as small as possible.

Second Embodiment

Figure 13:
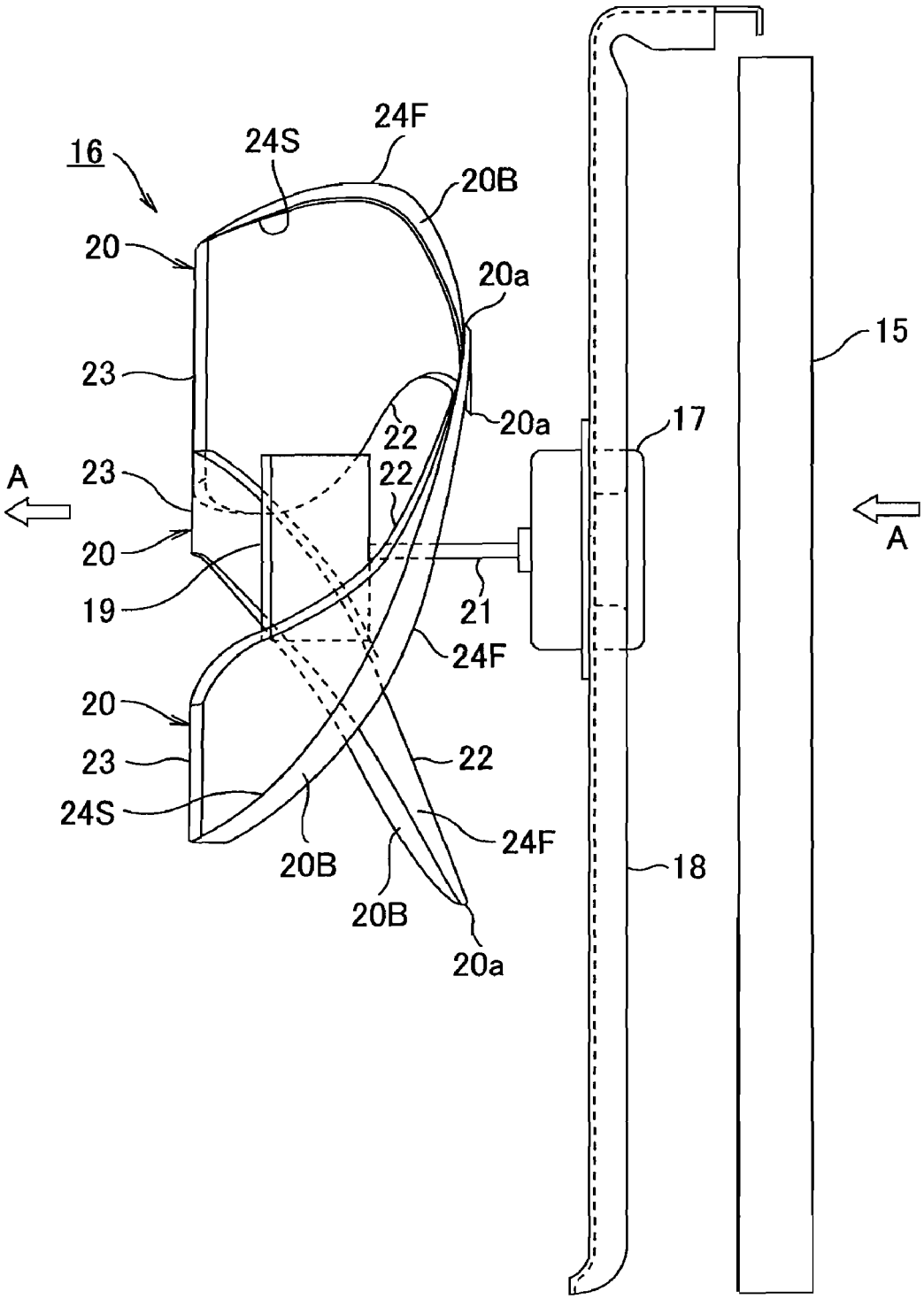
FIG. 13 is a diagram showing a main part of an outdoor unit to which a propeller fan according to a second embodiment is applied.

FIG. 13 shows a main part of an axial fan (propeller fan) according to a second embodiment of the present invention. Substantially the same elements as the axial fan of the first embodiment are represented by the same reference numerals, and the duplicative description thereof is omitted.

As shown in FIG. 13, a propeller fan 16 is joined to a fan motor 17, and the fan motor 17 is supported by a support plate 18 and disposed in front of a heat exchanger 15. The propeller fan 16 is driven by the fan motor 17 so that air (outside air) is blown from the inside of the heat exchanger 15 to the outside of the heat exchanger 15 as indicated by an arrow A of FIG. 13, whereby refrigerant and the outside air are heat-exchanged with each other in the heat exchanger 15.

Figure 14:
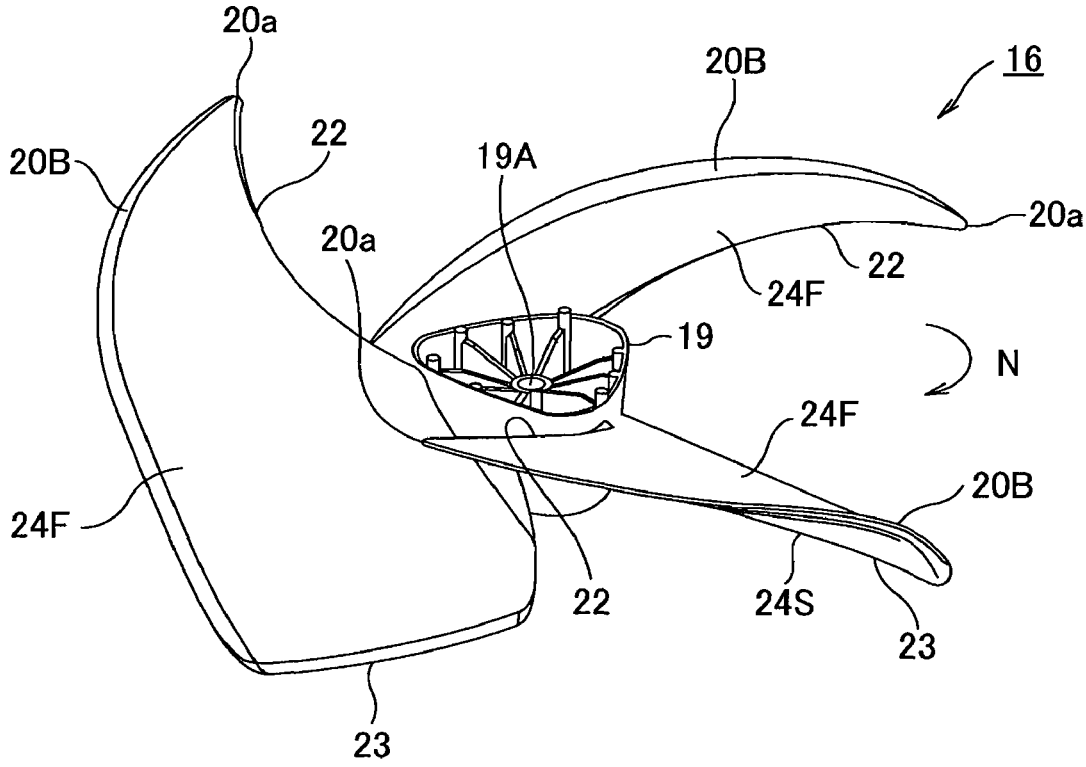
FIG. 14 is a perspective view showing the propeller.

As shown in FIG. 14, the propeller fan 16 is constructed by a hum portion 19 and a plurality of (for example, three) blades which are arranged at a predetermined pitch on the outer periphery of the hub portion 19 and have the same shape. The hub portion 19 and the blades 20 are integrally formed by resin molding.

The motor shaft 21 (FIG. 13) of the fan motor 17 is inserted in the rotational center 19A of the hub portion 19, and each blade 20 is rotated in the direction of an arrow N of FIG. 3 by driving the fan motor 17. This hub portion 19 is designed so that the outer shape is a triangular prism shape.

Figure 15:
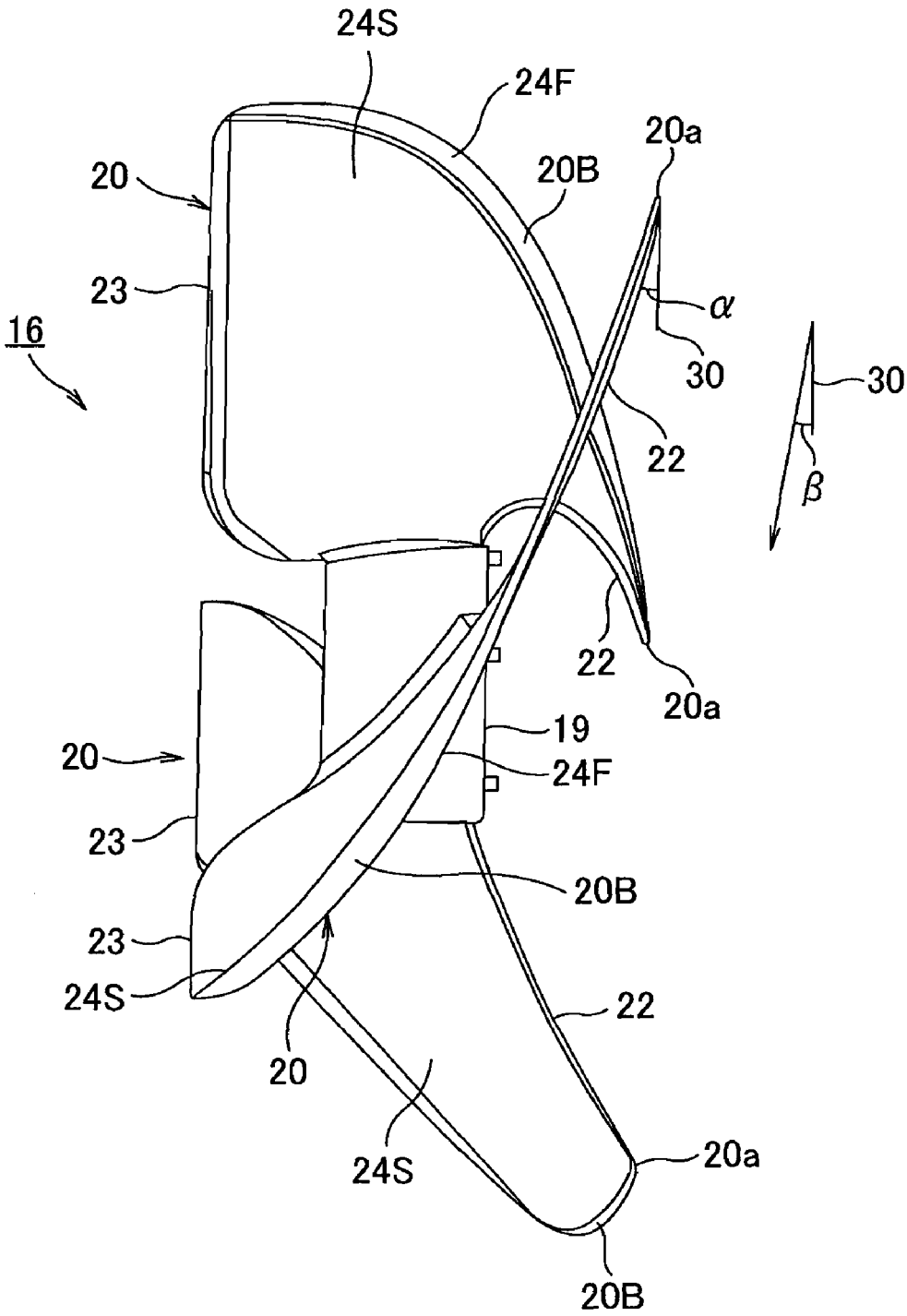
FIG. 15 is a side view showing the propeller.

As shown in FIGS. 14 and 15, the blade 20 makes air (outside air) flow along the blade negative pressure plane (the back surface of the blade) from the blade front edge 22 side to the blade rear edge 23 side by the rotation thereof in the arrow N direction, so that the air flows in the direction of an arrow A of FIG. 13 from the back side of the propeller 16 to the front side thereof as a whole.

As shown in FIG. 15, this blade 20 is designed to have such a three-dimensional curved surface shape that the blade surface is spatially distorted and the blade front edge 22 side thereof is greatly tilted forward to the air suction side.

It has been known that blade tip vortex occurs due to air stream spooled from the blade positive pressure plane (blade front surface) 24S to the blade negative plane (blade back surface) 24F when the propeller fan 16 is rotated. When this blade tip vortex is grown and exfoliates from the blade surface, noise (air blowing sound) is magnified.

Therefore, an additional blade 20B is formed at the outer peripheral portion (blade periphery) of the blade 20 so that the outer peripheral portion of the blade 20 (blade periphery) is bent to the blade negative pressure plane 24F side over the area from the blade front edge 22 side to the blade rear edge 23 side. By providing the additional blade 20B, blade tip vortex occurring in the neighborhood of the outer periphery of the blade 20 can be reduced to suppress the growth of the blade tip vortex, and also the exfoliation of the blade tip vortex from the blade plane can be suppressed, so that the noise caused by the blade tip vortex can be reduced.

A method of designing this blade 20 by using an arithmetic processing unit such as personal computer or the like which can perform arithmetic processing will be described.

The process of designing this blade 20 includes a basic blade designing step of designing a blade having only a basic curved surface and no additional blade 20B (hereinafter referred to as "basic blade 20A") and an additional blade designing step of partially changing the shape of the basic blade 20A designed in the basis blade design step to design an additional blade 20B. Through these steps, coordinate data representing the three-dimensional shape of the blade 20 can be achieved.

The coordinate data concerned are usable as design data by inputting the coordinate data to a three-dimensional CAD (Computer Aided Design). Furthermore, the coordinate data can be actively used as processing data by inputting the data to a metal molding apparatus for manufacturing a metal mold used for molding of the blade 20, for example.

The basic blade designing step is the same as the first embodiment, and thus the description thereof is omitted. Only the additional blade design step will be described.

<Additional Blade Designing Step>

Next, a method of designing the additional blade 20B by partially changing the shape of the basic blade 20A will be described.

Figure 16:
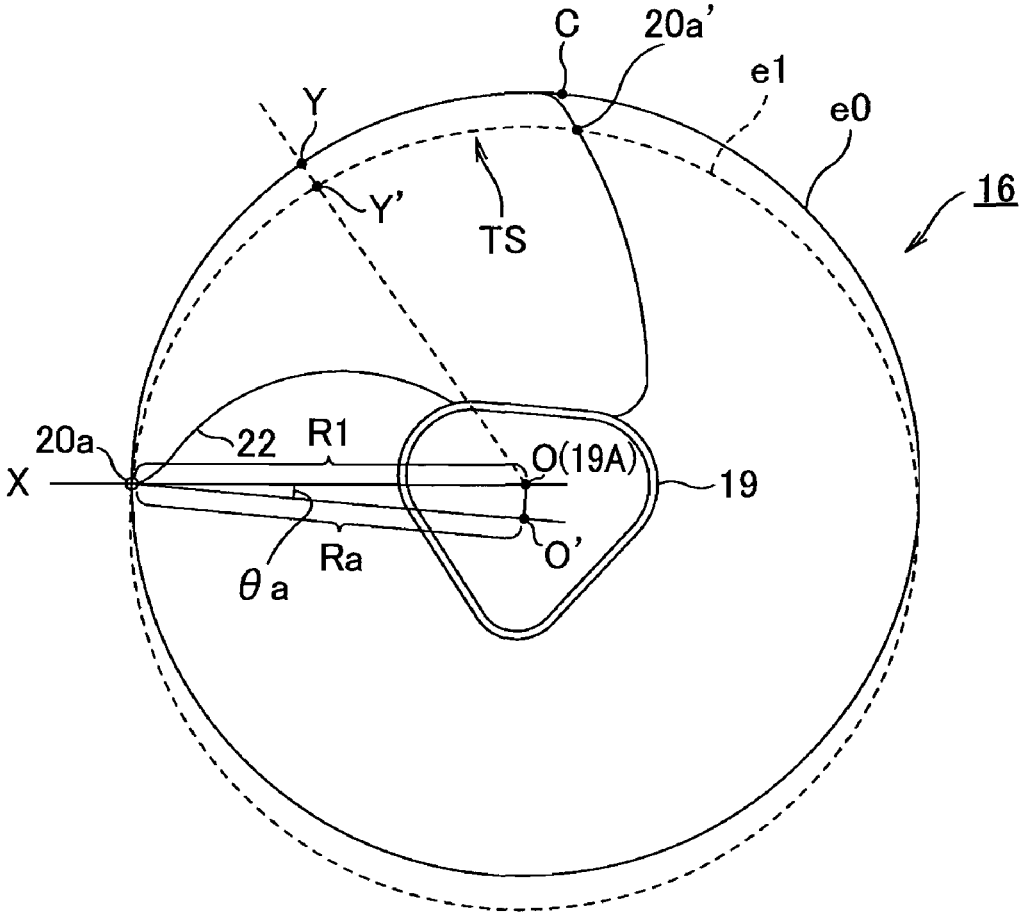
FIG. 16 is a diagram showing the blade shape changing start portion of the basic blade.

As shown in FIG. 16, in the coordinate system in which the rotational center 19A on a plane perpendicular to the rotational axis of the propeller fan 16 is set to an original point O, a reference point O' displaced from the original point O on the plane is set, and a circle e1 of a radius R1 which contains the reference point O' as the center thereof is drawn. At this time, an arc 20*a*-20*a*' on which the circle e1 and the basic blade 20A are overlapped with each other is set to a blade shape changing start portion TS as a bend start portion of the additional blade 20B.

For example, a straight line (the length thereof corresponds to the radius R1) connecting the original point O and the tip portion 20*a* of the blade front edge 22 of the basic blade 20A (hereinafter referred to as "blade outer peripheral tip portion") is rotated (clockwise in FIG. 16) around the blade outer peripheral tip portion 20*a* by any first angle $\theta_a$. At this time, the point to which the original point 0 is shifted is represented by a reference point O'. Here, the distance between the reference point O' and the blade outer peripheral tip portion 20*a* is represented by Ra(=R1). Then, a circle e1 which has the reference point O' as the center thereof and passes through the blade outer peripheral tip portion 20*a* is drawn around the reference point O'. At this time, the arc 20*a*-20*a*' corresponding to the overlap portion (curved line) between the circle e1 and the blade plane of the basic blade 20A is set as the blade shape changing start portion TS, and the coordinate data of the arc 20*a*-20*a*' are specified. At this time, one end of the blade shape changing start portion TS is coincident with the blade outer peripheral tip portion 20*a*. Here, the first angle $\theta_a$ is an angle which clockwise increases from the horizontal axis X passing through the original point O and the blade outer peripheral tip portion 20*a* around the blade outer peripheral tip portion 20*a*, and the radius (first radius) Ra of the circle e1 corresponds to the distance between the reference point O' and the blade outer peripheral tip portion a.

Actually, a mathematical formula for calculating the coordinate of the arc 20*a*-20*a*' is defined with the first angle $\theta_a$ as a variable by using the coordinate data of the blade outer peripheral tip portion 20*a*, and the position of the blade shape changing start portion TS can be calculated by merely indicating the numerical value of the first angle $\theta_a$ according to this mathematical formula. In this case, the bending variation range to be allocated to the additional blade 20B can be increased by increasing the first angle $\theta_a$. A circle e0 shown in FIG. 16 is a circle drawn around the original point O with the maximum radius R of the basic blade 20A. In this case, the circle e0 may be drawn so that some arc of the circle e0 is coincident with a portion of the outer periphery of the basic blade 20A as shown in FIG. 16.

The blade shape changing start portion TS is determined according to the above method. However, the blade shape changing start portion TS determines only the bending start portion of the additional blade 20B, and the shape of the curved surface of the additional blade 20B (corresponding to the height of the blade) is determined as follows.

Figure 17:
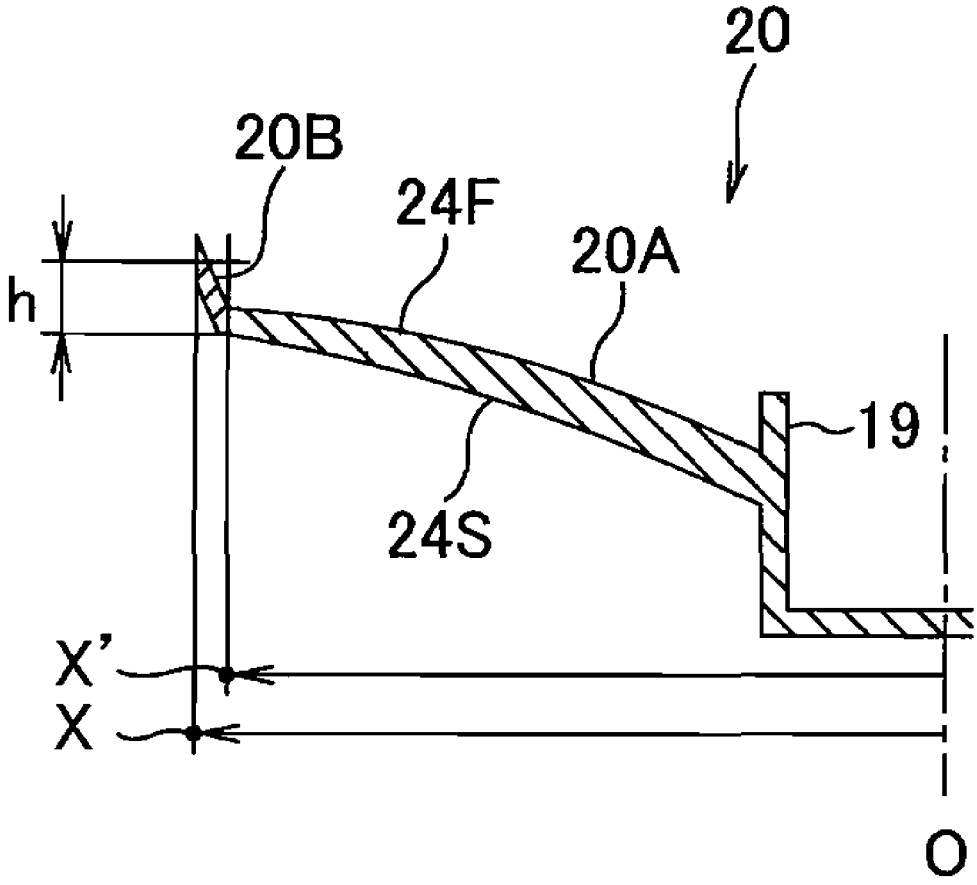
FIG. 17 is a cross-sectional view in the radial direction of the blade.

FIG. 17 is a cross-sectional view in the radial direction of the blade 20 (the cross-sectional view along O—Y'—Y of FIG. 16). The curved surface of the additional blade 20B is set by defining the variation amount h with respect to the blade height H of the basic blade 20A (see FIG. 6) by using a mathematical formula.

In this embodiment, the variation amount h of the curved surface of the additional blade 20B is defined by a mathematical formula containing as variables three values of the maximum variation amount d of the curved surface of the additional blade 20B, the gradient variation position l of the additional blade 20B and the maximum variation position m of the additional blade 20B.

Figure 18:
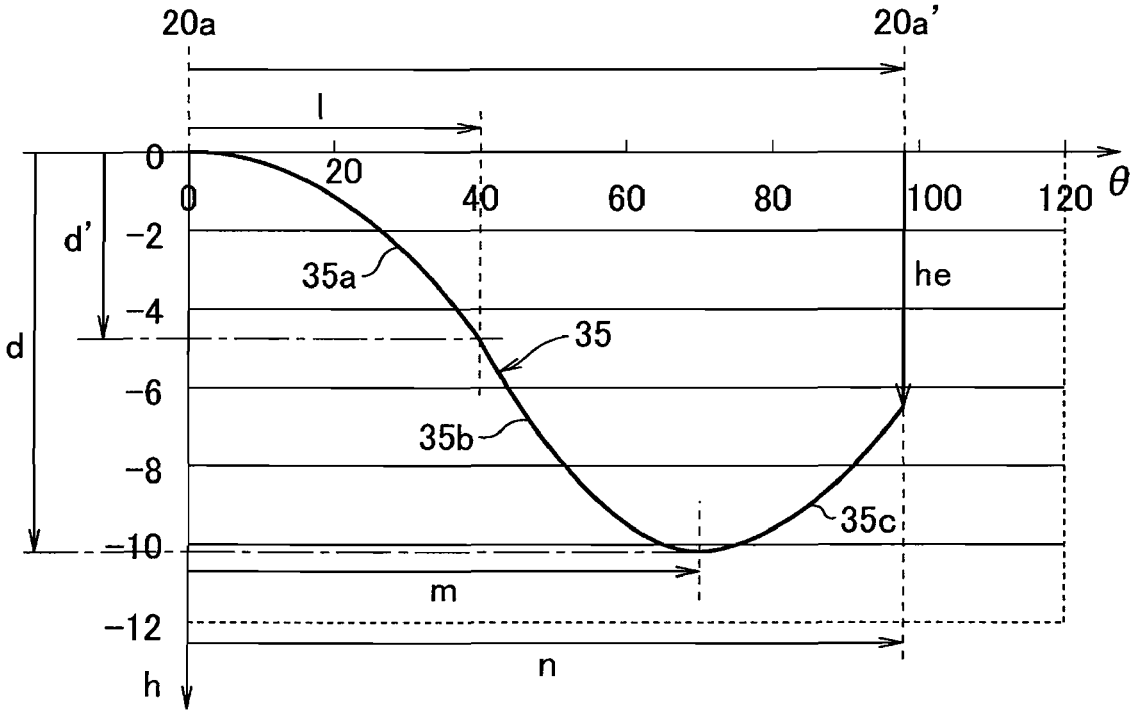
FIG. 18 is a diagram showing the cross-sectional view in the peripheral direction of the outermost periphery of the additional blade.

Here, FIG. 18 shows the peripheral cross-sectional shape of the outermost periphery of the additional blade 20B (the shape of the curved surface on the arc 20*a*-20*a*'). The abscissa axis of FIG. 18 is an angle θ in the peripheral direction of the basic blade 20A which clockwise increases from the horizontal axis X passing through the original point O and the blade outer peripheral tip portion a in FIG. 16, and the ordinate axis represents the variation amount h. A curved line 35 representing the variation amount h comprises a quadratic curve 35*a* (first mathematical formula) for smoothly connecting the blade outer peripheral tip portion 20*a* and the gradient variation position l of the additional blade 20B, a quadratic curve 35*b* (second mathematical formula) for smoothly connecting the gradient variation position 1 and the position of the maximum variation amount d (maximum variation position) and a quadratic curve 35*c* (third mathematical formula) for smoothly connecting the position of the maximum variation amount d and the curved surface end position.

Specifically, when the blade plane position in the blade outer peripheral portion (arc 20*a*-*c*) specified by the peripheral angle θ is represented by α (a≦α<c), the variation amount h of the curved surface of the additional blade 20B is defined by the mathematical formulas (11), (12), (13) corresponding to the respective quadratic curves 35*a*, 35*b*, 35*c*.

$$\text{For } \alpha \le 1, \quad h = -d'\left(\frac{\alpha}{l}\right)^2 \tag{11}$$

$$\text{For } 1 \le \alpha \le m, \quad h = (d-d')\left\{\left(\frac{m-\alpha}{m-l}\right)^2 - l\right\} - d' \tag{12}$$

$$\text{For } m \le \alpha \le n, \quad h = (d-d')\left\{\left(\frac{\alpha-m}{n-m}\right)^2 \cdot \left(1-\frac{he}{d}\right) - l\right\} - d' \tag{13}$$

Here, n represents a parameter indicating the variation end position of the curved surface which corresponds to the position of c in FIG. 16, d' is a parameter indicating the gradient variation amount, and he is a parameter indicating the variation amount of the curved surface at the curved surface end position. Preset default values may be applied as these parameters n, d' and he, or a mathematic formula using three variables (the maximum variation amount d of the curved surface of the additional blade 20B, the gradient variation position l and the maximum variation position m) may be defined and the parameters n, d' and he may be set by the mathematical formula.

Accordingly, the value of the variation amount h of the curved surface of the additional blade 20B is calculated by indicating the numerical values of the maximum variation amount d of the curved surface of the additional blade 20B, the gradient variation position 1 of the additional blade 20B and the maximum variation position m of the additional blade 20B. On the basis of the numerical value data of the variation amount h and the coordinate data of the basic blade 20A, the shape of the basic blade 20A can be partially changed, and the coordinate data of the blade 20 provided with the additional blade 20B can be achieved. The above process is the method of designing the additional blade 20B.

According to the design method of the additional blade 20B, the blade shape changing start portion TS of the basic blade 20A is defined and constructed by using as the variable only the first angle $\theta_a$ corresponding to the inner angle of the arc O—O' passing through the rotational center 19A (original point O) of the blade 20 which is drawn around the blade outer peripheral tip portion 20*a* as shown in FIG. 9. Therefore, the design of the blade shape changing start portion TS and the design change can be easily performed.

In addition, the reference point O' displaced from the rotational center 19A (original point O) of the blade 20 is set in accordance with the first angle $\theta_a$, and the arc 20*a*-20*a*' passing through the blade outer peripheral tip portion 20*a* with the reference point O' at the center thereof is set as the blade shape changing start portion TS, and thus under the state that the condition that one end of the blade shape changing start portion TS (the upstream side end portion in the rotational direction) is coincident with the blade outer peripheral tip portion 20*a* is certainly satisfied, the bending variation range to be allocated to the additional blade 20B can be freely adjusted. Accordingly, the degree of freedom for the design of the blade shape changing start portion TS can be sufficiently secured with avoiding increase of hissing sound (wind noise) occurring when the blade outer peripheral tip portion 20*a* gets into air stream.

Furthermore, the variation amount h representing the curved surface of the additional blade 20B is defined and constructed by the three variables of the maximum variation amount d of the curved surface of the additional blade 20B, the gradient variation position l of the additional blade 20B and the maximum variation position m of the additional blade 20B. Therefore, the variables indicated by the numerical values can be viscerally easily grasped and the design of the curved surface of the additional blade 20B and the design change can be easily performed.

In addition, the variation amount h is constructed by the curved line 35 comprising three quadratic curves 35*a*, 35*b*, 35*c*, and thus the shape variation from the blade outer peripheral tip portion 20*a* can be made smooth. In addition, a complicated curved surface shape can be designed, and the shape can be easily designed so that the resistance to air stream when the fan is rotated can be suppressed.

Accordingly, according to the design method of the additional blade 20B described above, the blade shape changing start portion TS and the variation amount h which define the additional blade 20B can be easily designed, and thus the additional blade 20B optimal to reduce the blade tip vortex and suppress exfoliation of the blade tip vortex from the blade plane can be easily designed.

In the above-described second embodiment, the outer peripheral portion of the blade 20 (blade periphery) is deformed to the blade negative pressure plane 24F side to provide the additional blade 20B. However, the present invention is not limited to this embodiment, and the outer peripheral portion of the blade 20 may be deformed to the blade positive pressure plane 24S side to provide the additional blade 20B.

Furthermore, in the above embodiment, when the blade shape changing start portion TS of the additional blade 20B is designed, one end of the blade shape changing start portion TS of the additional blade 20B is coincident with the blade outer peripheral tip portion 20*a*. However, the present invention is not limited to this embodiment.

Figure 19:
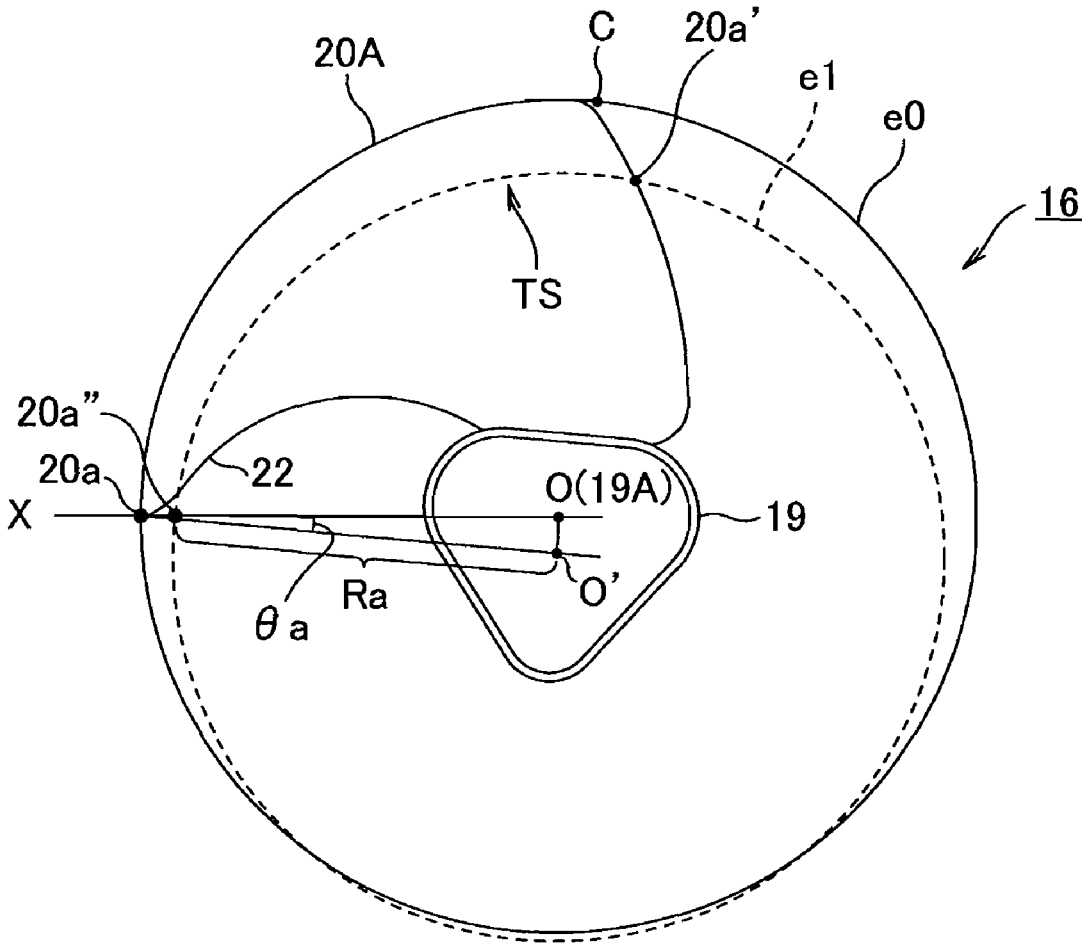
FIG. 19 is a diagram showing a modification of the blade shape changing start portion of the basic blade.

For example, as shown in FIG. 19, a reference point O' displaced from the rotational center 19A (original point O) of the blade 20 is set on the basis of the first angle $\theta_a$, and then the radius (first radius) Ra of a circle e1 containing the reference point O' as the center thereof is set to any radius, whereby a circuit e1 passing through the inside of the blade outer peripheral tip portion 20*a* is set. At this time, an arc 20*a*"-20*a*' on which the circle e1 and the basic blade 20A are overlapped with each other may be set as the blade shape changing start portion Ts. Actually, a mathematical formula containing the first angle $\theta_a$ and the first radius Ra as variables is defined, whereby the position of the blade shape changing start portion TS can be calculated by indicating the numerical values of the first angle $\theta_a$ and the first radius Ra.

In this case, the blade shape changing start portion TS which is substantially along the circumferential direction of the blade 20 can be set on the blade plane excluding the outer peripheral portion of the blade 20. It is preferable to add the blade shape changing start portion TS with an additional blade projecting to the blade negative pressure plane 24F side, for example, one or plural planar or projection type additional blades. By providing such an additional blade, exfoliation of air stream flowing in the neighborhood of the blade plane and occurrence of blade tip vortex can be prevented, and a blade proper to reduce the noise can be easily designed.

Furthermore, in this embodiment, an arc of any first angle $\theta_a$ is drawn from the rotational center 19A of the blade 20 (the original point O) with the tip portion of the blade front edge 22 (the blade outer peripheral tip portion 20*a*) as the center thereof while the distance between the rotational center 19A and the top portion is set to the radius R1, and the reference point O' is set to the end point of the arc. However, the present invention is not limited to this embodiment. For example, a displacement amount from the rotational center 19A of the blade 20 (original point O) is numerically set, and the reference point O' may be set on the basis of the displacement amount. In this case, the blade shape changing start portion TS which is substantially along the circumferential direction of the blade 20 can be easily set.

Furthermore, in the first and second embodiments, the present invention is applied to the propeller fan 16 having three fans. However, the present invention is not limited to this embodiment, and it may be applied to various axial fans having two fans, four fans, etc. Still furthermore, the present invention is not limited to the axial fan used in the outdoor unit 10, and it may be broadly applied to various axial fans used in a ventilation fan, an electric fan, etc.

What is claimed is:

1. An axial fan containing a hub portion having a rotational center and blades arranged on the outer periphery of the hub portion, including a thickness reinforcing portion that has a predetermined width and a predetermined thickness and extends along a blade front edge from a joint portion between a blade front edge portion of each blade and the hub portion to the outer periphery of the blade, wherein the width and thickness of the thickness reinforcing portion are made smaller as the distance from the rotational center of the hub portion is larger, wherein a thickness distribution curve is defined by using a logarithmic curve containing the distance from the rotational center of the hub portion as a variable, and the thickness reinforcing portion is designed so that the thickness thereof is based on the thickness distribution curve.

2. The axial fan according to claim 1, wherein the width and thickness of the thickness reinforcing portion are set to substantially zero at a predetermined position on the blade front edge at a blade front edge tip portion side.

3. The axial fan according to claim 2, wherein the thickness reinforcing portion is designed so that a plane area surrounded by a first curved line which extends from the predetermined position to the joint portion and is coincident with the outline of the blade front edge, and a second curved line achieved by rotating a curved line extending from the predetermined position along the outline of the blade front edge in the peripheral direction around the predetermined position by a predetermined angle, the second curved line extending to the intersection point between the curved line concerned and the hub portion, is set to a joint plane to the blade in the thickness reinforcing portion.

4. The axial fan according to claim 1, wherein the thickness distribution curve is calculated by applying a least-square method to a logarithmic function having plural parameters as a basic function so as to achieve an approximating curve passing through two points of a thickness maximum position at the joint portion and a thickness minimum position corresponding to the position farthest from the rotational center of the hub portion, and the thickness reinforcing portion is designed so as to have the thickness based on the thickness distribution curve.

5. The axial fan according to claim 1, wherein the thickness reinforcing portion is provided at a positive pressure plane side of the blade.

6. A method of designing a blade of an axial fan including a hub portion having a rotational center and blades arranged on the outer periphery of the hub portion, comprising the steps of:

defining end portions of the blade indicated by an angle in a peripheral direction by using mathematical formulas when a coordinate system containing the rotational center as an original point on a plane perpendicular to the rotational axis of the blade is set, and defining a radial cross-sectional shape of the blade at any angular position in the coordinate system by using mathematical formulas containing as a variable the difference between the distance from any point to the rotational center at the angular position concerned and the distance from the blade tip to the rotational center at the angular position concerned, thereby designing a basic blade of the blade;

setting a first curved line that extends from any position T on the blade front edge to a joint portion between the hub portion and the blade and is coincident with the outline of the blade front edge, setting a second curved line that is achieved by rotating a curved line having the same curvature as the outline of the blade front edge around the position T1 concerned in a peripheral direction by a predetermined angle and extends from the position T1 to the intersection point between the curved line concerned and the hub portion, a plane area surrounded by the firsts and second curved lines being set as a joint plane to the blade in the thickness reinforcing portion, defining the first and second curved lines specifying the joint plane concerned by using mathematical formulas containing as variables the position T1 and the predetermined rotational angle or the intersection point T3 between the second curved line and the hub portion, and defining a thickness distribution shape of the thickness reinforcing portion by using mathematical formulas containing the thickness maximum value hm at the joint portion and the position T1 when the thickness of the thickness reinforcing portion is smaller as the distance from the rotational center of the hub portion is larger, thereby designing the thickness reinforcing portion of the blade; and manufacturing a metal mold used to mold the designed blade.

7. The blade designing method for the axial fan according to claim 6, wherein the width and thickness of the thickness reinforcing portion are set to substantialiy zero at a predetermined position on the blade front edge at the blade front edge tip portion side.

8. The biade designing method for the axial fan according to claim 6, wherein a thickness distribution curve using a logarithmic curve containing the distance from the rotational center of the hub portion as a variable is defined, and the thickness reinforcing portion is designed so that the thickness thereof is based on the thickness distribution curve.

9. The blade designing method for the axial fan according to claim 8, wherein the thickness distribution curve is determined by calculating an approximating curve passing through two points of a thickness maximum position hm at the joint portion and a thickness minimum position corresponding to a position farthest from the rotational center of the hub portion according to a least-square method using a logarithmic function, and the thickness reinforcing portion is designed so that the thickness thereof is based on the thickness distribution curve.

10. The blade designing method for the axial fan according to claim 6, wherein the thickness reinforcing portion is provided to a positive pressure plane side of the blade.

* * * * *